US006756549B2

(12) United States Patent
Suzuki et al.

(10) Patent No.: US 6,756,549 B2
(45) Date of Patent: Jun. 29, 2004

(54) POWER CONTROL APPARATUS

(75) Inventors: Mika Suzuki, Shizuoka (JP); Takayoshi Endo, Shizuoka (JP); Hironori Kondo, Shizuoka (JP); Goro Nakamura, Shizuoka (JP); Norihiro Ohashi, Shizuoka (JP); Takahiro Satoh, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 10/164,590

(22) Filed: Jun. 10, 2002

(65) Prior Publication Data

US 2002/0187659 A1 Dec. 12, 2002

(30) Foreign Application Priority Data

Jun. 11, 2001 (JP) ..... 2001-175914
Jun. 11, 2001 (JP) ..... 2001-176065

(51) Int. Cl.[7] ..... H01H 19/00
(52) U.S. Cl. ..... 200/19.07; 200/11 R
(58) Field of Search ..... 200/19.07, 19.03, 200/19.18, 19.19, 33 R, 35 R, 11 G, 275, 500, 501, 19.01, 19.08, 19.31, 11 D, 11 DA, 36, 37, 11 R, 19.3; 307/112–116

(56) References Cited

U.S. PATENT DOCUMENTS 2,204,892 A 6/1940 Heady
2,965,725 A 12/1960 Mason
3,912,886 A * 10/1975 Allen et al. ..... 200/11 A
5,744,766 A * 4/1998 Sambar et al. ..... 200/16 A
6,392,173 B1 * 5/2002 Hirano et al. ..... 200/245

FOREIGN PATENT DOCUMENTS

| | | |
|---|---|---|
| DE | 665 863 | 10/1938 |
| DE | 10 83 894 | 6/1960 |
| EP | 1 204 130 A1 | 5/2002 |
| GB | 273 966 | 7/1927 |
| JP | 9-251830 | 9/1997 |
| JP | 10-241522 | 9/1998 |
| JP | 11-219631 | 8/1999 |
| JP | 11-354005 | 12/1999 |
| JP | 367461 | * 12/2002 |
| JP | 367462 | * 12/2002 |

* cited by examiner

*Primary Examiner*—Elvin Enad
*Assistant Examiner*—Lisa Klaus
(74) *Attorney, Agent, or Firm*—Sughrue Mion, PLLC

(57) ABSTRACT

A rotating terminal (16) has a circumferential outer peripheral surface (21*a*, 24*a*) having its center disposed at an axis (13, 21*b*) of rotation of the rotating terminal, and has electrically conductive areas and non-electrically conductive areas alternately arranged on the outer peripheral surface in the circumferential direction. At least one pair of fixed terminals (17, 18) are fixed and disposed outwardly of a path of rotation of the outer peripheral surface of the rotating terminal. In accordance with a rotating position of the rotating terminal, the pair of fixed terminals can be switched between an electrically-conducting condition, in which the pair of fixed terminals are electrically connected together through the rotating terminal, and an interrupting condition in which the pair of fixed terminals are not electrically connected together through the rotating terminal.

21 Claims, 17 Drawing Sheets

POWER CONTROL APPARATUS

BACKGROUND OF THE INVENTION

This invention relates to a power control apparatus provided on a power supply line so as to effect the interruption of power supply and so on.

FIGS. 16 to 18 show one conventional power control apparatus of the type described (serving as a power interrupting apparatus) disclosed in JP-A-11-219631. As shown in FIGS. 16 to 18, the power interrupting apparatus 100 comprises a casing 101, made of a synthetic resin, a motor 102, fixedly mounted on this casing 101, a worn gear 103, fixedly mounted on a rotation shaft 102*a* of the motor 102, a worn wheel portion 104 disposed in mesh with this worm gear 103, a pivotal (swinging) terminal 105 (serving as a moving terminal), pivotally mounted at one side portion thereof on the casing 101, a pair of opposed fixed terminals 106 and 107, disposed near respectively to upper and lower sides of a path of pivotal movement of the pivotal terminal 105, and resilient contact elements 108 and 109 mounted respectively on inner surfaces of the fixed terminals 106 and 107.

The pivotal terminal 105 has a conducting portion 110 and an insulating portion 111 juxtaposed to each other in a direction of pivotal movement of this pivotal terminal. One of the two fixed terminals 106 and 107 is electrically connected to a power source while the other is electrically connected to a load.

In the above construction, the motor 102 is driven to pivotally move the pivotal terminal 105, and when the conducting portion 110 of the pivotal terminal 105 is brought into a swinging position where this conducting portion 110 is inserted between the pair of fixed terminals 106 and 107 as shown in FIG. 16, the pair of fixed terminals 106 and 107 are electrically connected together through the pivotal terminal 105, thus achieving an electrically-conducting condition.

When the insulating portion 111 of the pivotal terminal 105 is brought into the swinging position where this insulating portion 111 is inserted between the pair of fixed terminals 106 and 107 as shown in FIG. 17, the pair of fixed terminals 106 and 107 are electrically disconnected from each other through the pivotal terminal 105, thus achieving an interrupting condition.

In the above conventional power interrupting apparatus 100, however, the pivotal terminal 105 is provided as the moving terminal, and the upper and lower surfaces of this pivotal terminal 105, disposed in the same direction as the direction of rotation of this pivotal terminal, serve as contact surfaces for the pair of fixed terminals 106 and 107. Therefore, there was encountered a problem that a space, larger than a space for mounting the pivotal terminal 105, need to be secured as a space for moving the pivotal terminal 105, and this was one of the causes for the increased size of the apparatus.

In the above conventional power interrupting apparatus 100, however, the conducting portion 110 of the pivotal terminal 105 is slidingly inserted between the resilient contact elements 108 and 109 (fixedly secured at their opposite ends to the pair of fixed terminals 106 and 107, respectively), and therefore is contacted with these resilient contact elements. Therefore, if the gap between the pair of fixed terminals 106 and 107 varies to decrease even slightly, the sliding insertion of the pivotal terminal 105 would become extremely difficult, and if the gap between the pair of fixed terminals 106 and 107 varies to increase even slightly, the pressure of contact between the resilient contact elements 108 and 109 and the conducting portion 110, as well as the area of contact therebetween, would extremely decrease. Therefore, this construction is not suited for the type of power interrupting apparatus to be provided on a power supply line for flowing a large current therethrough.

SUMMARY OF THE INVENTION

Therefore, this invention has been made in order to solve the above problem, and an object of the invention is to provide a power control apparatus in which a space for moving a moving terminal is available merely by securing a space for mounting this moving terminal, and the overall size of the apparatus can be reduced. Further, an object of the invention is to provide a power control apparatus which can be suitably used for a power supply line of a large current.

In order to solve the aforesaid object, the invention is characterized by having the following arrangement.

(1) A power control apparatus comprising:

a rotating terminal including a circumferential outer peripheral surface, and having electrically conductive areas and non-electrically conductive areas alternately arranged on the outer peripheral surface in a circumferential direction thereof; and a pair of fixed terminals fixed and disposed outwardly of a path of rotation of the outer peripheral surface, wherein the pair of fixed terminals is switched between an electrically conducting condition in which the pair of fixed terminals are electrically connected together through the rotating terminal, and an interrupting condition in which the electrical connection between the pair of fixed terminals through the rotating terminal is interrupted in accordance with a rotating position of the rotating terminal.

(2) The power control apparatus according to (1), wherein the rotating terminal is rotated by a driving force of a motor.

(3) The power control apparatus according to (2) further comprising a controller for controlling the driving of the motor so as to control the electrical connection between the pair of fixed terminals and the interruption of the electrical connection.

(4) The power control apparatus according to (3) further comprising a manual switch for feeding a power interrupting instruction to the controller.

(5) The power control apparatus according to (1) further comprising a current sensor for detecting a current level of a power supply line which can be made conductive and can be interrupted by the rotation of the rotating terminal.

(6) The power control apparatus according to (1), wherein the pair of electrically conductive areas are symmetric with respect to an axis of rotation of the rotating terminal, and the pair of non-electrically conductive areas are symmetric with respect to the axis thereof.

(7) The power control apparatus according to (1), wherein a multi-contact spring member is provided at the electrically conductive areas for electrically connecting the pair of fixed terminals.

(8) The power control apparatus according to (7), wherein the multi-contact spring member includes a rail member extending between the electrically conductive areas, and a plurality of resilient contact springs projecting outwardly from the rail member at the electrically conductive areas, which is brought into contact with the pair of fixed terminal in the electrically conducting condition.

(9) The power control apparatus according to (8), wherein the plurality of contact spring project in an inclined manner so as to extend toward a direction opposite to a rotating direction of the rotating terminal.

(10) The power control apparatus according to (1), wherein an electrically-conductive contact spring is provided at the outer peripheral surface of the rotating terminal, and the contact spring is fixed at one end thereof to the outer peripheral surface while the other end thereof serving as a free end projects from the outer peripheral surface, and each of the pair of fixed terminal includes a contact surface in which the contact spring can be brought into contact with the contact surface in a resiliently-deformed condition.

(11) The power control apparatus according to (10), wherein insulating frames are disposed adjacent to the outer peripheral surface of the rotating terminal, and are provided respectively at other regions than the regions where the pair of fixed terminals are provided, and the insulating frames have respective contact surfaces, and the contact surfaces of the insulating frames and the contact surfaces of the pair of fixed terminal are disposed on a common circle, and jointly form a substantially perfect circumferential surface.

(12) The power control apparatus according to (10), wherein the electrically-conductive areas are formed respectively of an electrically-conducting member at an outer peripheral surface, and the non-electrically conducting areas are formed respectively of isolation portions at outer peripheral surfaces.

(13) The power control apparatus according to (1), wherein sacrifice terminal portions are provided respectively upstream of the contact surfaces of the pair of fixed terminals in a rotating direction of the rotating terminal.

(14) The power control apparatus according to (10), wherein a plurality of the contact springs are provided at the outer peripheral surface of the rotating terminal.

(15) the power control apparatus according to (10), wherein the contact spring is inclined in such a manner that the free end of the contact spring is disposed downstream of fixed end of the contact spring in the rotating direction of the rotating terminal.

(16) The power control apparatus according to (12), wherein the rotating terminal comprises the electrically conducting member, and insulating resin caps attached to the electrically conducting member, and the resin cap includes a spring receiving groove in which a rail member, interconnecting the contact springs, is received and fixed held.

(17) The power control apparatus according to (1), wherein electrically-conductive contact spring are provided at the peripheral surfaces of the fixed terminals, and each contact spring is fixed at its one end to the peripheral surface while the other end thereof serving as a free end projects from the outer peripheral surface, and the rotating terminal has a contact surface, and the contact spring can be brought into contact with the contact surface in a resiliently-deformed condition.

DETAILED DESCRIPTION OF PREFERRED EMBODIMENTS

A preferred embodiment of the present invention will now be described with reference to the drawings.

Figure 1:
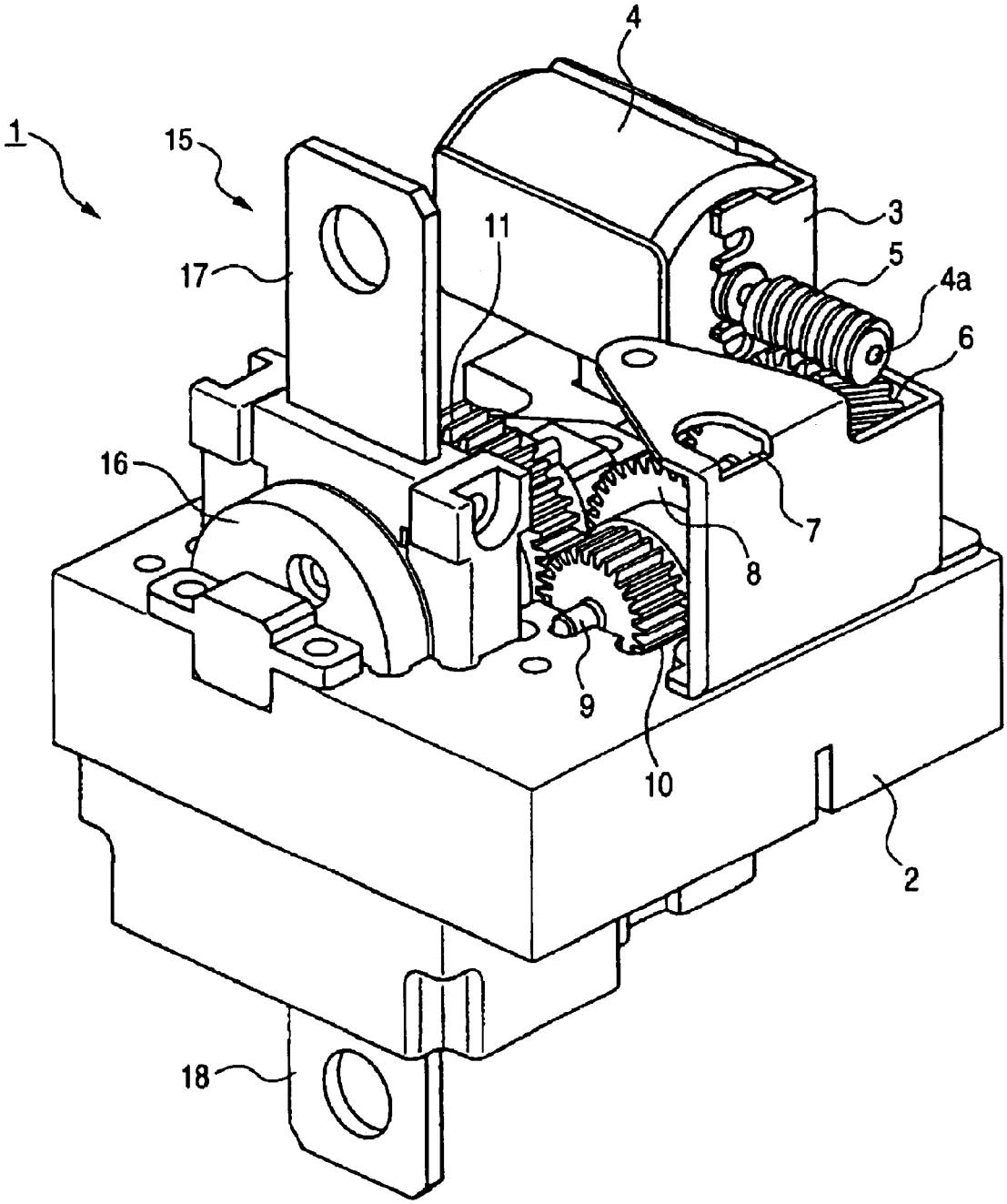
FIG. 1 is a perspective view of a first embodiment of a power interrupting apparatus of the invention.
Figure 2:
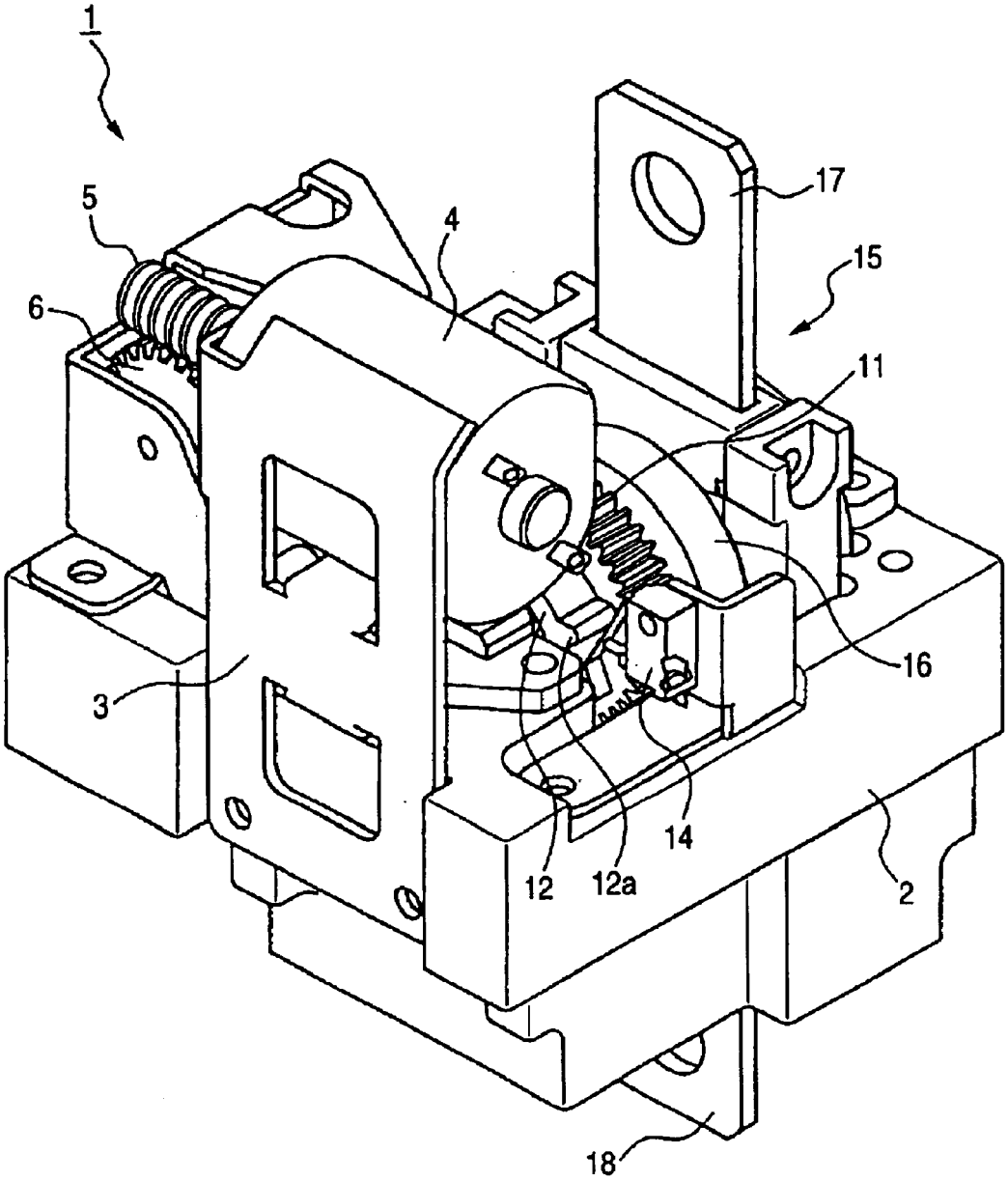
FIG. 2 is a perspective view of the power interrupting apparatus of the first embodiment as viewed from a direction different from that of FIG. 1.
Figure 3:
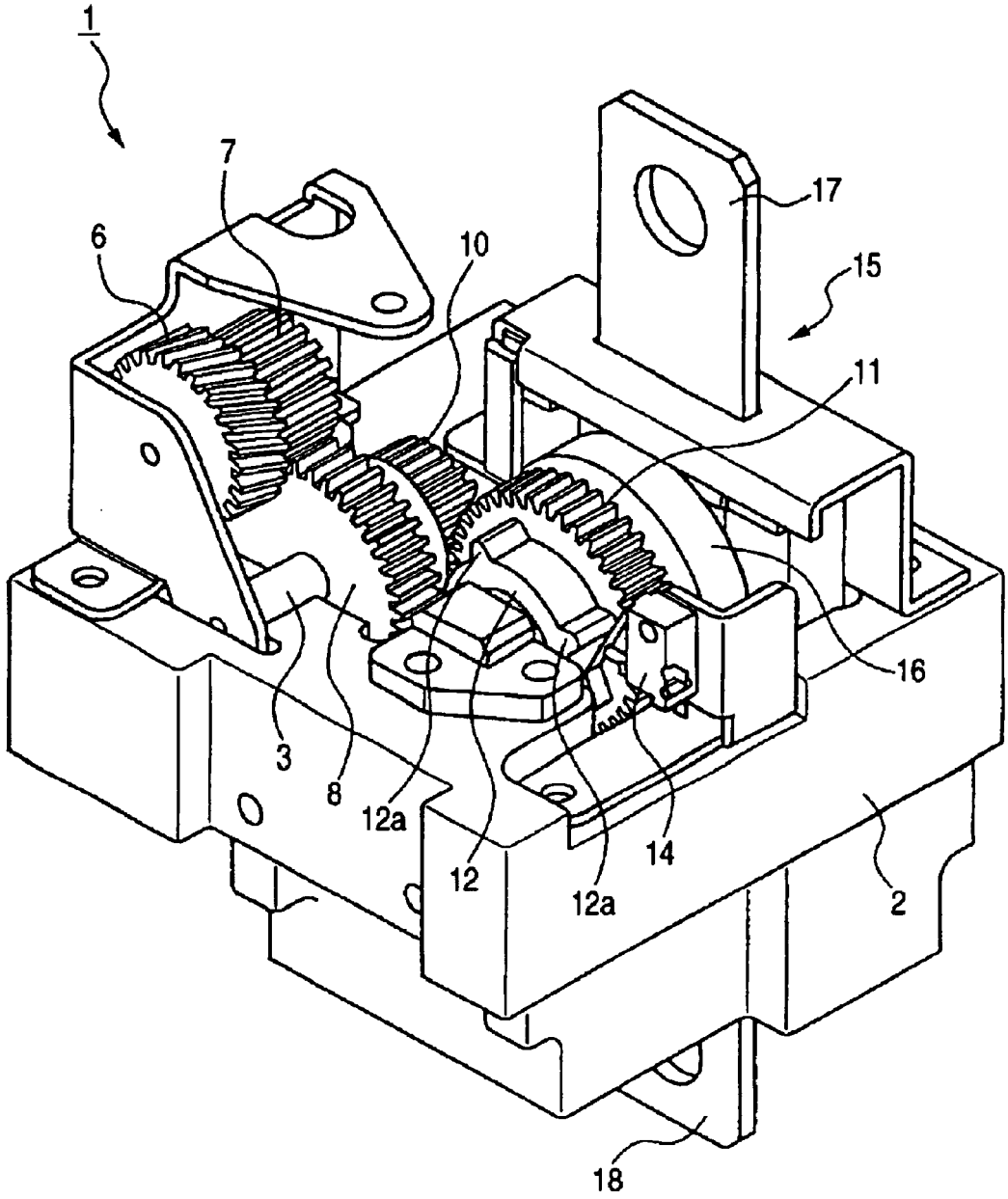
FIG. 3 is a perspective view identical to FIG. 2, but showing a condition in which a motor is removed.
Figure 4:
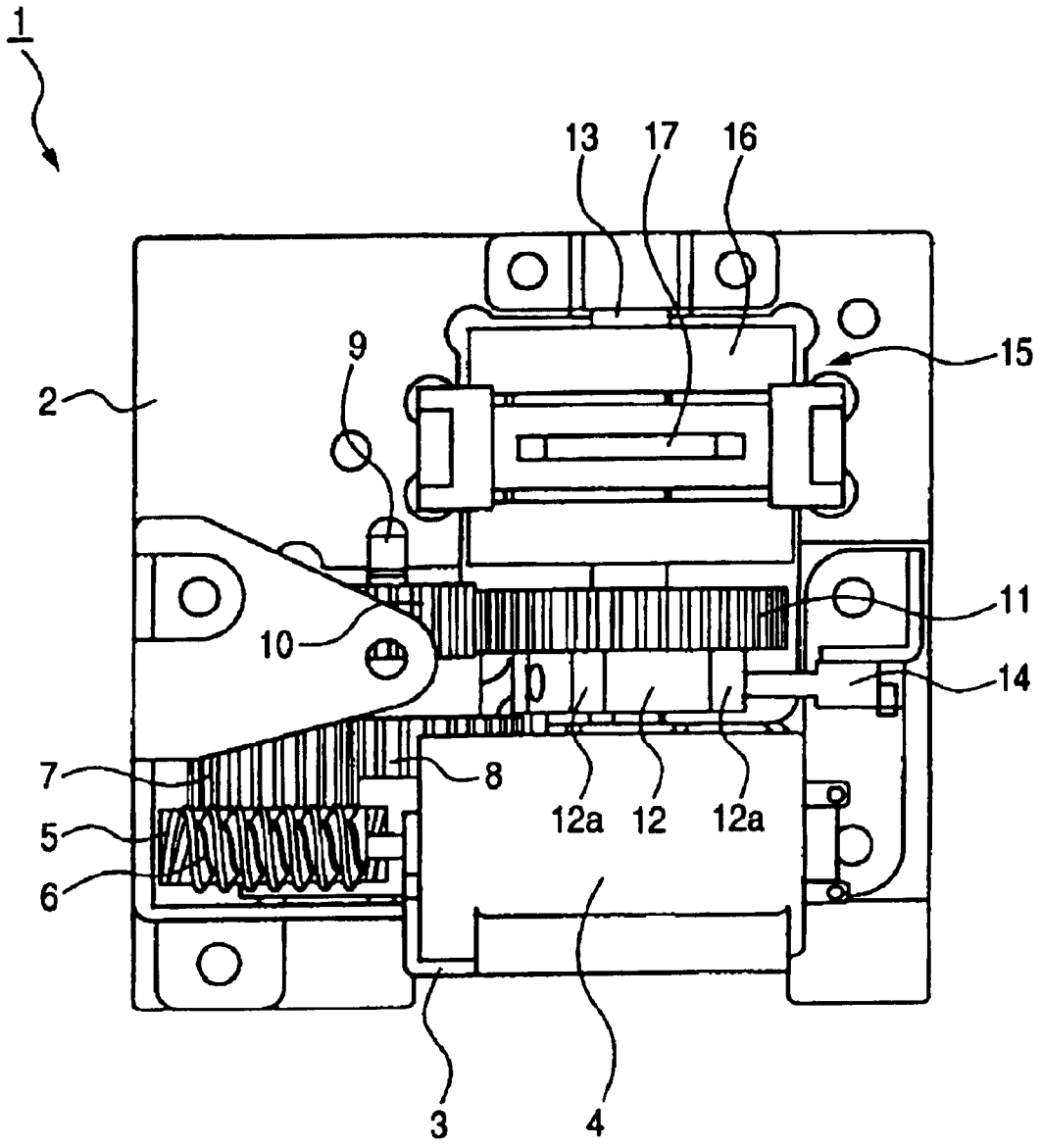
FIG. 4 is a plan view of the power interrupting apparatus of the first embodiment.
Figure 5:
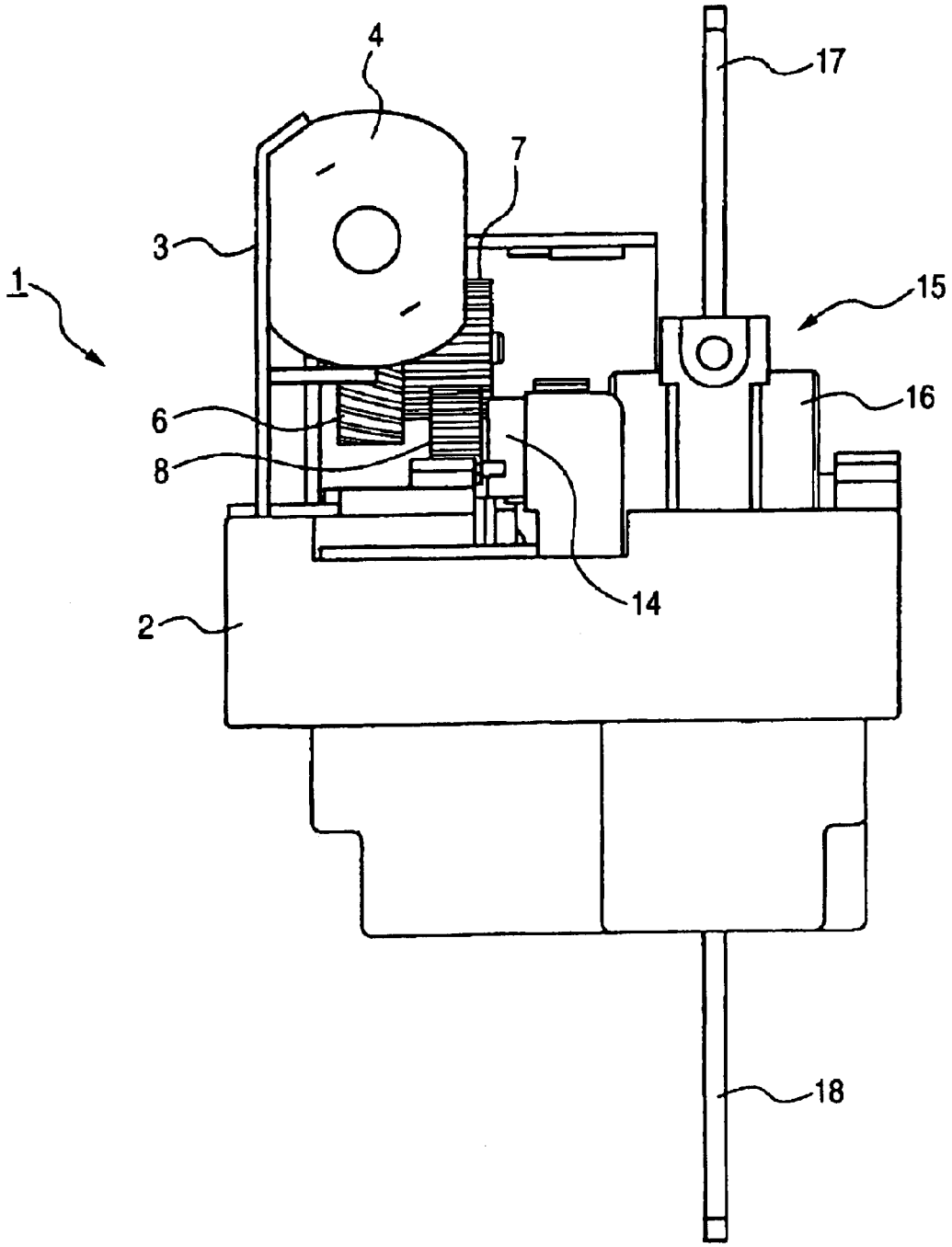
FIG. 5 is a right side-elevational view of the power interrupting apparatus of the first embodiment.
Figure 6:
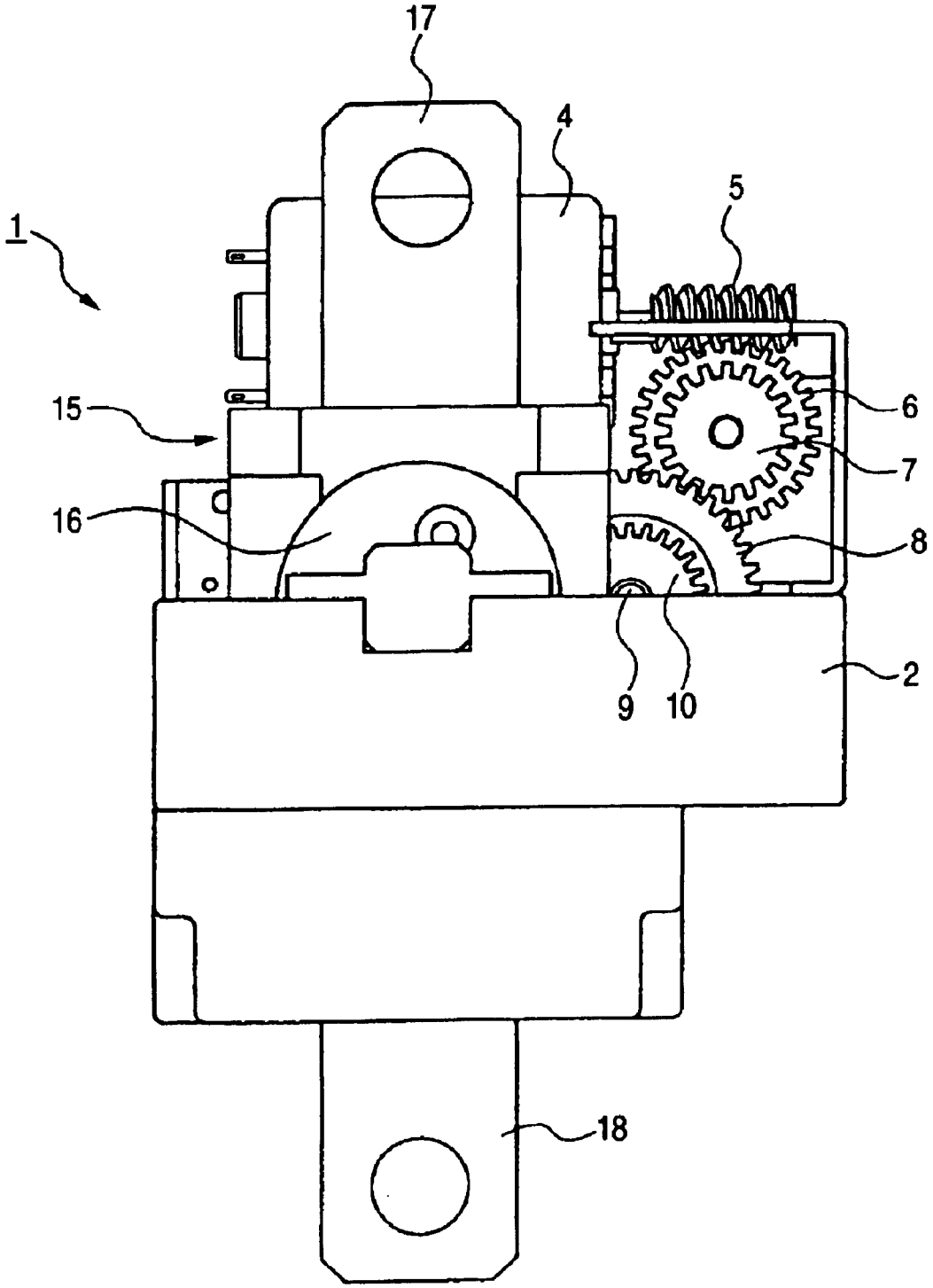
FIG. 6 is a rear view of the power interrupting apparatus of the first embodiment.
Figure 10A:
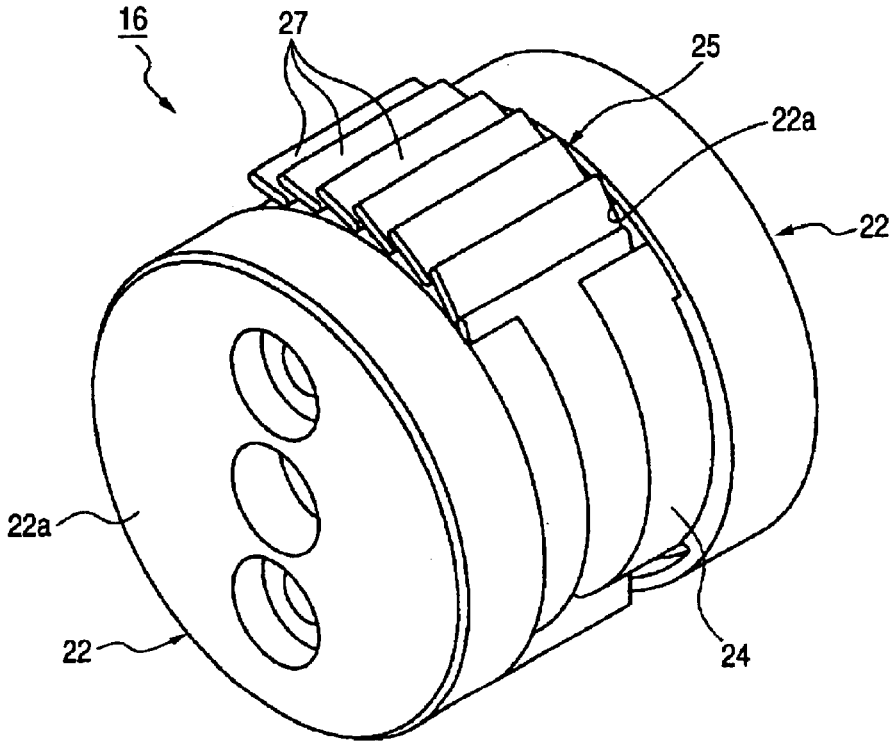
FIG. 10A is a perspective view of a rotating terminal of the first embodiment.
Figure 10B:
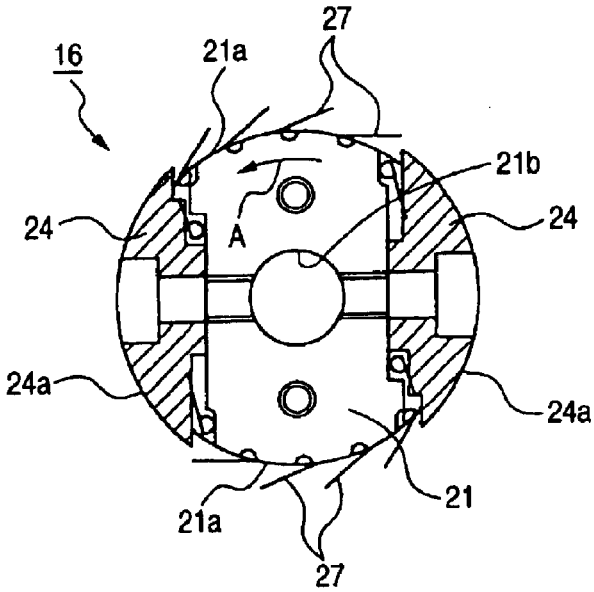
FIG. 10B is a cross-sectional view of the rotating terminal.
Figure 11A:
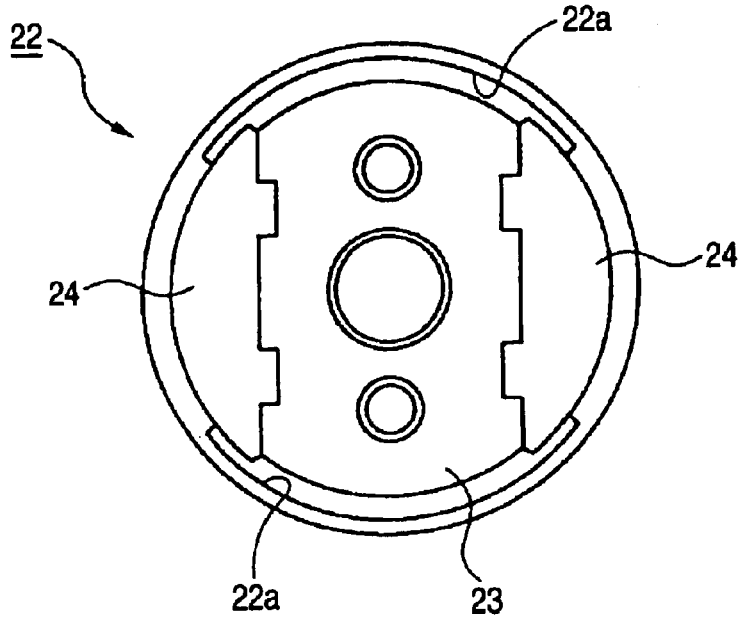
FIG. 11A is a view showing the interior of a resin cap of the first embodiment.
Figure 11B:
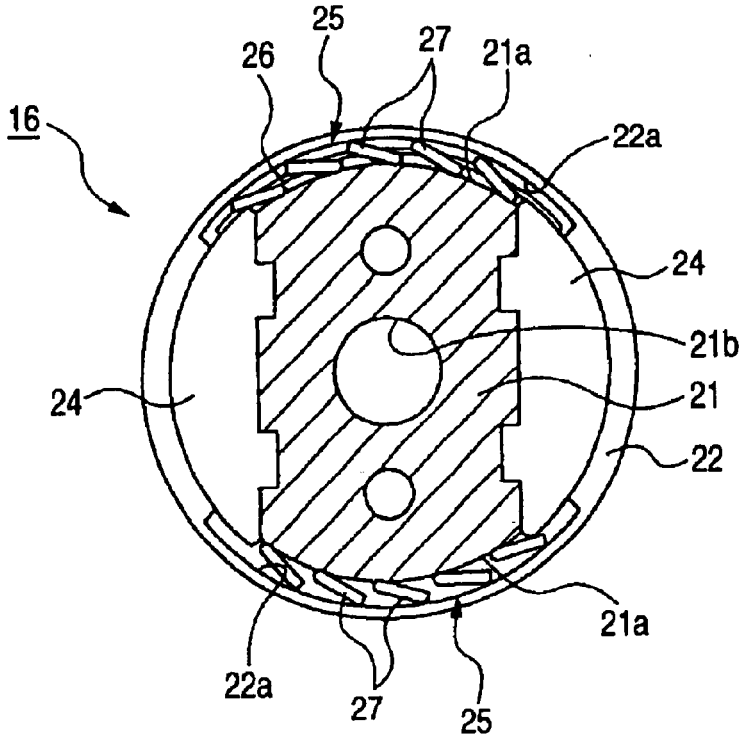
FIG. 11B is a cross-sectional view showing a condition in which an electrically-conducting member is attached to the resin caps.
Figure 12:
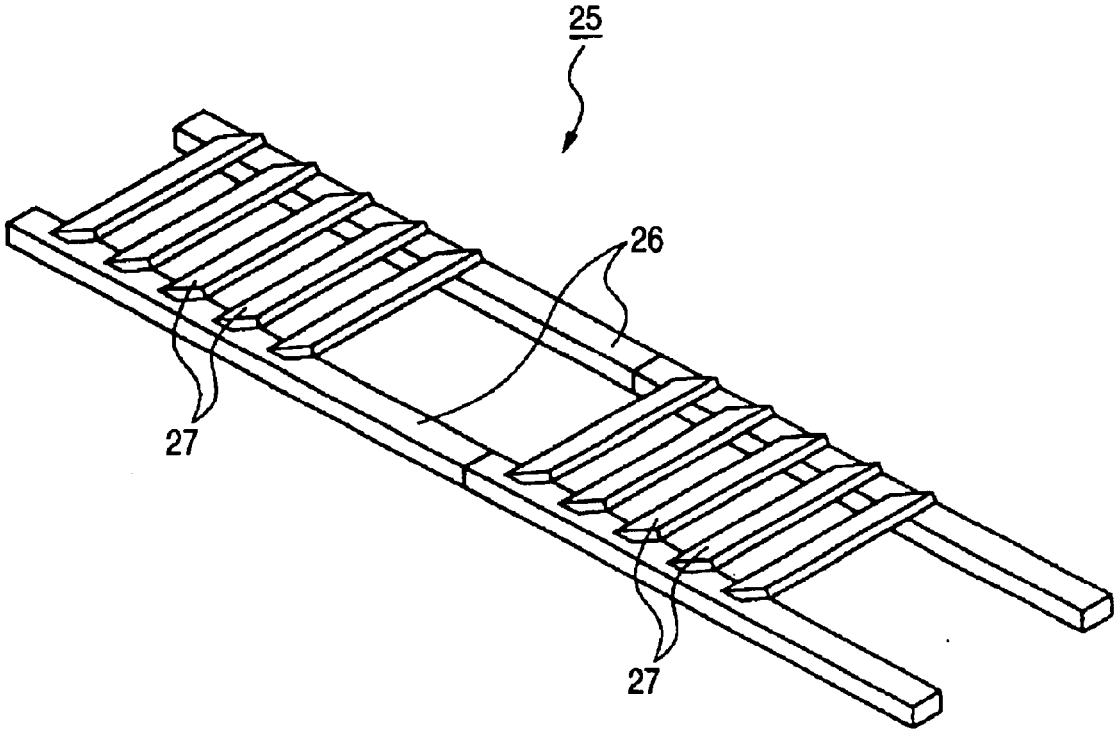
FIG. 12 is a perspective view of the multi-contact spring member of the first embodiment before it is attached.
Figure 13:
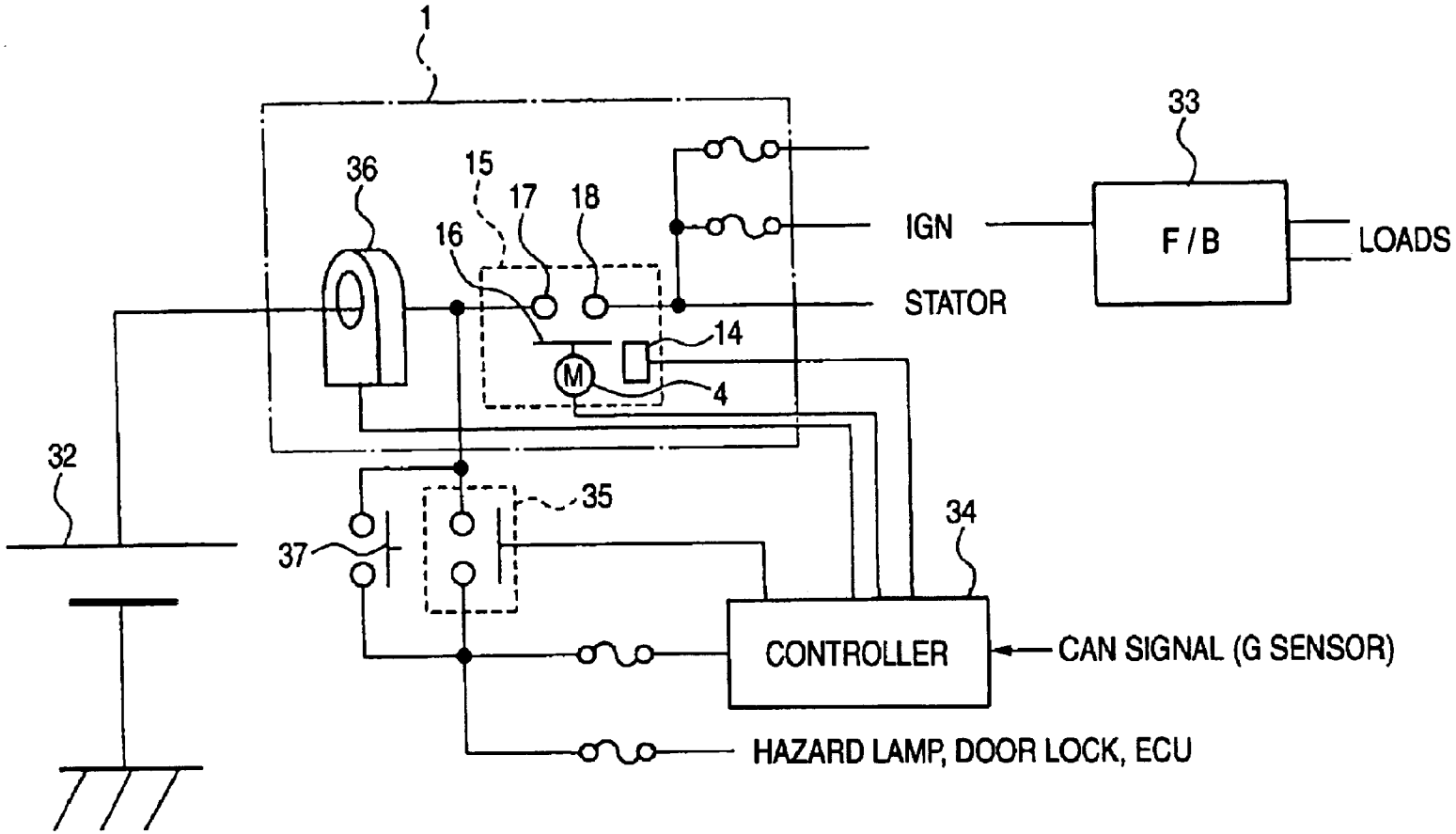
FIG. 13 is a circuit diagram of part of a circuit incorporating the power interrupting apparatus.

FIGS. 1 to 13 show a power interrupting apparatus (power control apparatus) according to a first embodiment of the invention. FIG. 1 is a perspective view of the power interrupting apparatus, FIG. 2 is a perspective view of the power interrupting apparatus as viewed from a direction different from that of FIG. 1, FIG. 3 is a perspective view identical to FIG. 2, but showing a condition in which a motor is removed, FIG. 4 is a plan view of the power interrupting apparatus, FIG. 5 is a right side-elevational view of the power interrupting apparatus, FIG. 6 is a rear view of the power interrupting apparatus, FIG. 7 is a perspective view of a terminal switching portion, FIG. 8A is a front-elevational view of the terminal switching portion, showing a condition in which a pair of fixed terminals are electrically connected together, FIG. 8B is a front-elevational view of the terminal switching portion, showing a condition in which the pair of fixed terminals are disconnected from each other, FIG. 9 is an exploded, perspective view of the terminal switching portion, with multi-contact spring member omitted, FIG. 10A is a perspective view of a rotating terminal, FIG. 10B is a cross-sectional view of the rotating terminal, FIG. 11A is a view showing the interior of a resin cap, FIG. 11B is a cross-sectional view showing a condition in which an electrically-conducting member is attached to the resin caps, FIG. 12 is a perspective view of the multi-contact spring member before it is attached, and FIG. 13 is a circuit diagram of part of a circuit incorporating the power interrupting apparatus.

As shown in FIGS. 1 to 6, a motor (drive source) 4 is mounted on and fixed to a base member 2 of the power interrupting apparatus (power control apparatus) 1 through a bracket 3, and a worm gear 5 is fixedly mounted on a rotation shaft 4*a* of this motor 4. A worm wheel 6 is engaged with the worm gear 5, and a first spur gear 7 is fixedly secured to this worm wheel 6. A second spur gear 8 is engaged with this first spur gear 7, and a third spur gear 10 is fixedly mounted on a support shaft 9 of this second spur gear 8. An output spur gear 11 is engaged with this third spur gear 10, and a detection member 12 is fixedly secured to one side of this output spur gear 11, and the rotating terminal 16 of the terminal switching member 15 is fixedly mounted on a support shaft 13 of the output spur gear 11.

The detection member 12 has radially-projecting detection projections circumferentially spaced an angle of 90 degrees from one another, and a limit switch 14 for detecting these detection projections 12*a* is fixedly mounted on the base member 2. Rotating positions of the rotating terminal 16 spaced an angle of 90 degrees from one another, that is, electrically-conducting positions (i.e., a position of FIG. 8A and a position angularly spaced 180 degrees from this position) and interrupting positions (i.e., a position of FIG. 8B and a position angularly spaced 180 degrees from this position), are detected through the detection output of the limit switch 14. The detection output of the limit switch 14 is fed to controller 34 (described later).

Figure 7:
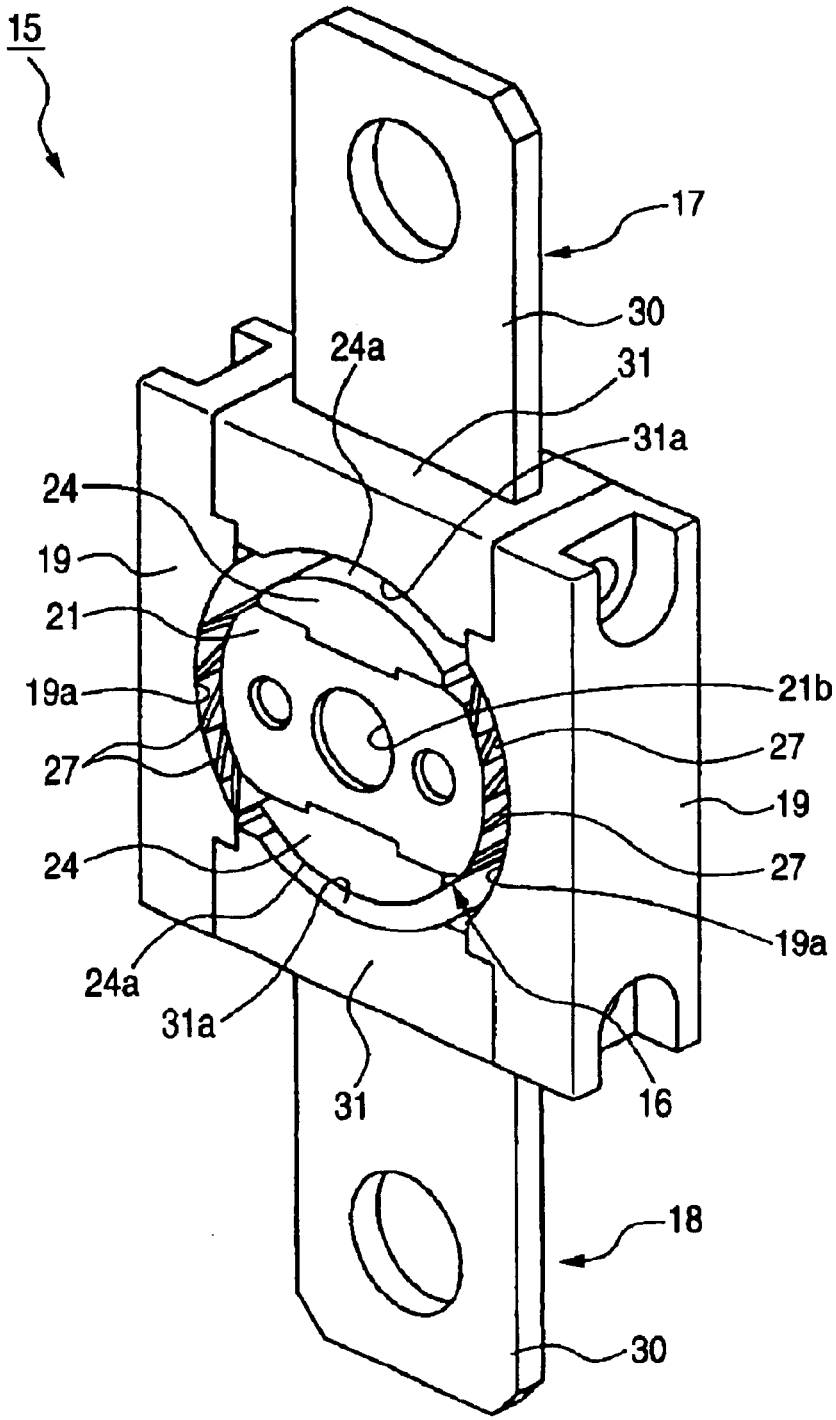
FIG. 7 is a perspective view of a terminal switching portion of the first embodiment.
Figure 8A:
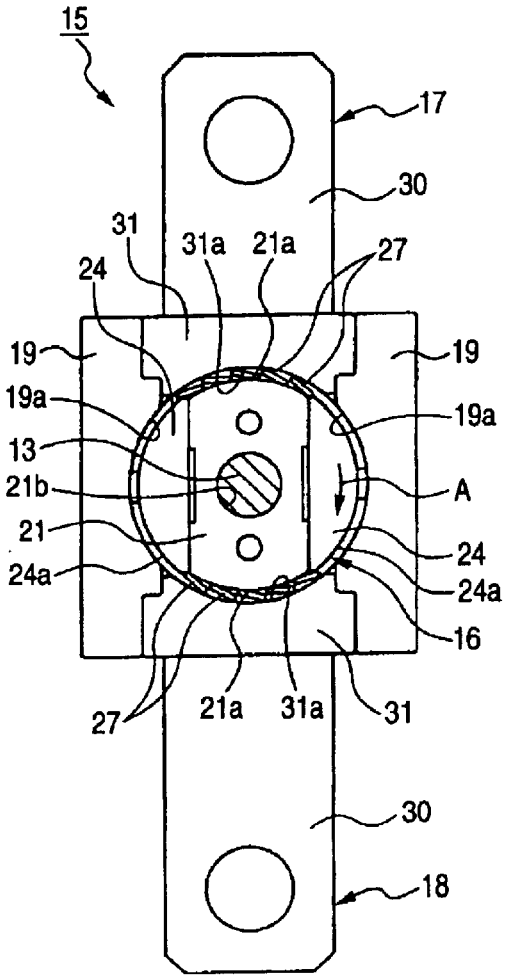
FIG. 8A is a front-elevational view of the terminal switching portion of the first embodiment, showing a condition in which a pair of fixed terminals are electrically connected together.
Figure 8B:
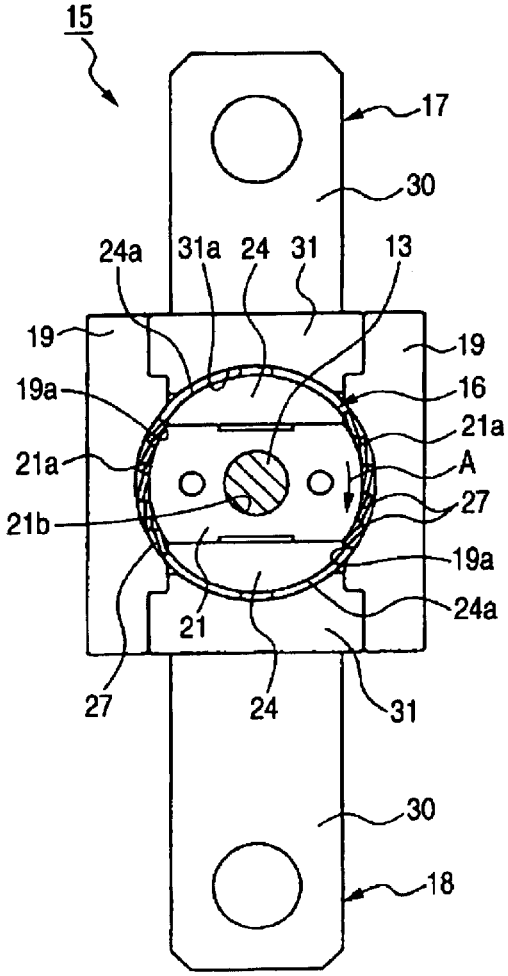
FIG. 8B is a front-elevational view of the terminal switching portion, showing a condition in which the pair of fixed terminals are disconnected from each other.
Figure 9:
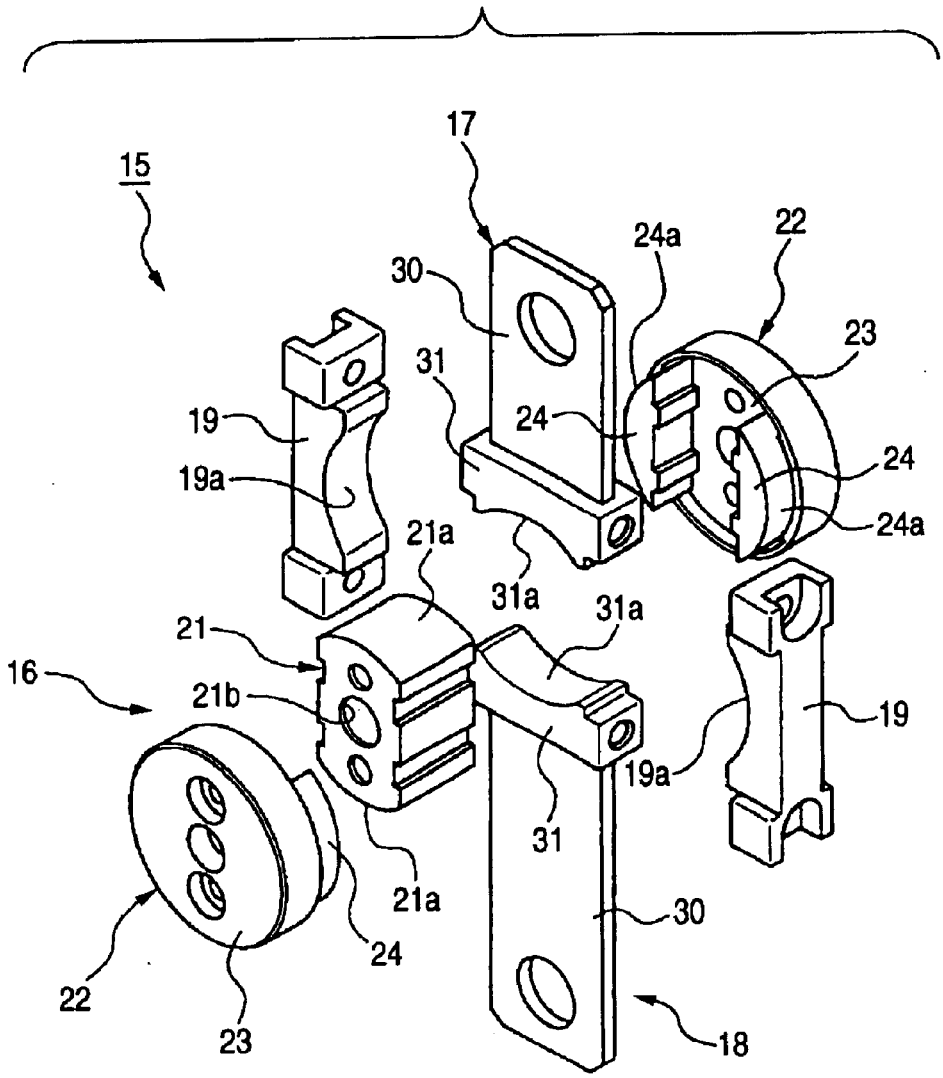
FIG. 9 is an exploded, perspective view of the terminal switching portion of the first embodiment, with multi-contact spring member omitted.

As shown in FIGS. 7 to 9, the terminal switching portion 15 comprises the rotating terminal 16 of a cylindrical shape, the pair of fixed terminals 17 and 18, which are electrically connected to and disconnected from each other in accordance with the rotating position of the rotating terminal 16, and a pair of resin frames (insulating frames) 19 and 19 fixing the pair of fixed terminals 17 and 18 to each other.

As shown in FIGS. 10 and 11, the rotating terminal 16 comprises the electrically-conducting member 21, having diametrically-opposite arcuate outer peripheral surfaces 21*a* (angularly spaced 180 degrees from each other) extending over a predetermined rotation angle, the pair of resin caps 22 and 22 of an insulative nature attached to this electrically-conducting member 21 to cover opposite sides (faces) thereof, and the multi-contact spring member 25 mounted on the electrically-conducting member 21 in such a manner that a plurality of contact springs 27 of each multi-contact spring member 25 project from the corresponding outer peripheral surface 21*a*.

A shaft insertion hole 21*b*, serving as an axis of rotation, is formed through a central portion of the electrically-conducting member 21, and the support shaft 13 (serving as the axis of rotation) is fitted in this shaft insertion hole 21*b*. Each of the resin caps 22 includes a disk portion 23, which is held in intimate contact with the side of the electrically-conducting member 21 to cover the same, a pair of insulating isolation portions 24 and 24 projecting from one side of the disk portion 23, and the pair of insulating isolation portions 24 are disposed respectively at those portions of the outer periphery of the electrically-conducting member 21 at which the outer peripheral surfaces 21*a* are not provided. Each of the insulating isolation portions 24 has an outer peripheral surface 24*a* having the same diameter as that of each outer peripheral surface 21*a* of the electrically-conducting member 21, and the outer peripheral surface of the rotating terminal 16, having a substantially perfect circumferential shape, is defined by the outer peripheral surfaces 21*a* of the electrically-conducting member 21 and the outer peripheral surfaces 24*a* of the insulating isolation portions 24. With respect to the outer peripheral surface of the rotating terminal 16, the outer peripheral surfaces 21*a* of the electrically-conducting member 21 serve as electrically-conductive areas, and the outer peripheral surfaces 24*a* of the insulating isolation portions 24 serve as non-electrically-conductive areas, and the electrically-conductive areas and the non-electrically-conductive areas are alternately disposed at intervals of 90 degrees in the rotating direction.

The multi-contact spring member 25 is made of an electrically-conductive, resilient material, and has a shape, shown in FIG. 12, before it is mounted on the rotating terminal. More specifically, the multi-contact spring member 25 comprises a pair of parallel rail members 26 and 26, and the plurality of contact springs 27 fixedly secured to the pair of rail members 26 and 26 in a manner to bridge them. The pair of rail members 26 and 26 are held in intimate contact with the outer peripheral surface 21*a* of the electrically-conducting member 21 in the direction of the periphery thereof, and in this intimately-contacted condition, the pair of rail members 26 and 26 are fitted in spring receiving grooves 22*a* formed in the pair of resin caps 22 and 22, thereby fixing the multi-contact spring member 25.

The plurality of contact springs 27 are fixedly secured only at their one ends (edges) to the pair of rail members 26 and 26, and the other (free) ends (edges) thereof project from the outer peripheral surface 21*a* of the electrically-conducting member 21. The contact springs 27 do not project perpendicularly from the outer peripheral surface 21*a* of the electrically-conducting member 21, but project in an inclined manner generally at the same angle. More specifically, each contact spring 27 is inclined in such a manner that its free end is disposed downstream of its fixed end in the direction (indicated by arrow A in FIGS. 8A and 8B) of rotation of the rotating terminal 16. When each contact spring 27 is brought into contact with the pair of fixed terminals 17 and 18 (described later) and a contact surface 19*a* of each resin frame 19 (described later), the contact spring 27 is resiliently deformed to be further inclined toward the outer surface 21*a*, 24*a*, and therefore contacts the pair of fixed terminals 17 and 18 and the resin frames 19 with a contact pressure resulting from a restoring force of this resilient deformation.

For assembling the rotating terminal 16, the pair of rail members 26 and 26 of each multi-contact spring member 25 are resiliently deformed in such a manner that those portions of the multi-contact spring member 25 having the contact springs 27 are held in intimate contact with the diametrically-opposite outer peripheral surfaces 21*a* (angularly spaced 180 degrees from each other) of the electrically-conducting member 21, respectively, and the pair of resin caps 22 and 22 are attached to the electrically-conducting member 21 while the pair of rail members 26 and 26 of each multi-contact spring member 25 are fitted in the spring receiving grooves 22*a*, respectively, and then the pair of resin caps 22 and 22 are fixedly secured to the electrically-conducting member 21, for example, by nuts and screws (not shown), thus completing the assembling operation.

The pair of fixed terminals 17 and 18 are disposed immediately adjacent to upper and lower sides of the rotating terminal 16, respectively, and are made of an electrically-conductive material. Each of the fixed terminals 17 and 18 comprises a flat plate-like wire connection portion 30, and a contact block portion 31 fixedly secured to the wire connection portion 30. That side of each contact block portion 31, facing the rotating terminal 16, is formed into an arcuate contact surface 31*a*. As shown in FIG. 13, the wire connection portion 30 of the fixed terminal 17 is electrically connected to a battery 32 while the other fixed terminal 18 is electrically connected to loads.

The pair of resin frames (insulating frames) 19 and 19 are disposed immediately adjacent to the right and left sides of the rotating terminal 16, respectively, and are made of an insulative resin. Each of the resin frames 19 are fixedly secured at its upper and lower ends to the contact block portions 31 of the pair of upper and lower fixed terminals 17 and 18 by screws (not shown), and that side of each resin frame 19, facing the rotating terminal 16, is formed into an arcuate contact surface 19*a*. The contact surfaces 19*a* of the resin frames 19 and the contact surfaces 31*a* of the contact block portions 31 of the two fixed terminals 17 and 18 jointly form a substantially perfect circumferential surface, and this circumferential surface has its center disposed at the axis of rotation of the rotating terminal 16, and also has a diameter slightly larger than the diameter of the outer peripheral surfaces 21*a* and 24*a* of the rotating terminal 16. In other words, the contact surfaces 19*a* of the resin frames 19 and the contact surfaces 31*a* of the contact block portions 31 of the two fixed terminals 17 and 18 are disposed slightly outwardly of the path of rotation of the outer peripheral surfaces 21*a* and 24*a* of the rotating terminal 16.

Next, part of the circuit, incorporating the power interrupting apparatus 1 of the above construction, will be described. As shown in FIG. 13, the power interrupting apparatus 1 is provided on a power supply line for supplying power of the battery 32 to the loads via a fuse box 33. More specifically, the fixed terminal 17 is electrically connected to the battery while the other fixed terminal 18 is electrically connected to the loads, as described above, and the motor 4 for rotating the rotating terminal 16 so as to electrically connect and disconnect the pair of fixed terminals 17 and 18 relative to each other is controlled by the controller 34. The detection output of the limit switch 14 is inputted to the controller 34, and in accordance with this detection output, the rotating terminal 16 can be moved to a selected one of the electrically-conducting position (shown in FIG. 8A), the position, angularly spaced 180 degrees from this position, the interrupting position (shown in FIG. 8B) and the position angularly spaced 180 degrees from this position.

A latch/relay circuit 35, when turned on, supplies power to the controller 34, and also supplies power to a hazard lamp, door locks, an electronic control unit (ECU) and so on. The electronic control unit supervises and controls an apparatus (e.g. an automobile) on which the power interrupting apparatus 1 is mounted, and various information is inputted to this electronic control unit. Among such information, there is information for a manual switch (for a power interrupting instruction) operable by the user, and information for an acceleration sensor (in an emergency such as the activation of an air bag), and when the manual switch is operated or when the acceleration sensor (G sensor) detects acceleration of above a predetermined level, the electronic control unit feeds a power interrupting instruction signal to the controller 34. The controller 34, when receives this signal, causes the motor 4 to be driven so as to move the rotating terminal 16 to the interrupting position, thereby interrupting the power supply line or turning off the latch/relay circuit 35.

A current sensor 36 is contained in the power interrupting apparatus 1, and detects a current level of the power supply line, and feeds this detection result to the controller 34. When the controller 34 judges that the current is at an abnormal level as of a rush current or a dark current, this controller 34 causes the motor 4 to be driven so as to move the rotating terminal 16 to the interrupting position, thereby interrupting the power supply line.

When a manual reset switch 37 is turned on in the OFF-state of the latch/relay circuit 35, electric power is supplied to this latch/relay circuit 35 and the controller 34 to reset them into the ON-state. Upon resetting into the ON-state, the controller 34 causes the motor 4 to be driven so as to move the rotating terminal 16 to the electrically-conducting position. As a result, the supply of electric power to the load is resumed.

Next, the operation of the power interrupting apparatus 1 of the above construction will be described. Let's assume that the rotating terminal 16 is now disposed in the electrically-conducting position shown in FIG. 8A. In this electrically-conducting position, the electrically-conducting member 21 is electrically contacted with the fixed terminals 17 and 18 through the two groups of contact springs 27, and therefore electric power is supplied to the loads via the power supply line. When the power interrupting instruction signal is fed to the controller 34 or when the current sensor 36 detects an abnormal current, the controller 34 feeds the drive signal to the motor 4, so that the rotating terminal 16 is rotated in the direction of arrow A shown in FIG. 8A. As a result, the two groups of contact springs 27 move in sliding contact with the contact surfaces 31*a* of the contact block portions 31 of the two fixed terminals 17 and 18, respectively, and slide past these contact surfaces 31*a*, respectively, and then move in sliding contact with the contact surfaces 19*a* of the two resin frames 19 and 19. Namely, the point of contact of each contact spring 27 shifts gradually from the contact surface 31*a* of the contact block portion 31 of the corresponding fixed terminal 17, 18 to the contact surface 19*a* of the corresponding resin frame 19.

In the 90 degrees-rotated position shown in FIG. 8B, the two groups of contact springs 27 have completely shifted respectively from the contact surfaces 31*a* of the contact block portions 31 of the two fixed terminals 17 and 18 to the contact surfaces 19*a* of the resin frames 19, and therefore the rotating terminal is disposed in the interrupting position where the pair of fixed terminals 17 and 18 are not electrically connected together through the rotating terminal 16. This 90 degrees-rotated position is detected by the limit switch 14, and when the rotating terminal arrives this interrupting position, the driving of the motor 4 is accurately stopped through the controller 34.

For example, when a power interruption-canceling instruction signal is fed from the electronic control unit (ECU) to the controller 34 or when the manual reset switch 37 is turned on, the controller 34 feeds the drive signal to the motor 4, and the rotating terminal 16 is rotated in the direction of arrow A shown in FIG. 8B. As a result, the two groups of contact springs 27 move in sliding contact with the contact surfaces 19*a* of the two resin frames 19 and 19, respectively, and slide past these contact surfaces 19*a*, respectively, and then move in sliding contact with the contact surfaces 31*a* of the contact block portions 31 of the two fixed terminals 17 and 18, respectively, and thus the point of contact of each contact spring 27 shifts gradually from the contact surface 19*a* of the corresponding resin frame 19 to the contact surface 31*a* of the contact block portion 31 of the corresponding fixed terminal 17, 18.

In the 90 degrees-rotated position, the two groups of contact springs 27 have completely shifted respectively from the contact surfaces 19*a* of the resin frames 19 to the contact surfaces 31*a* of the contact block portions 31 of the two fixed terminals 17 and 18, and therefore the rotating terminal is disposed in the electrically-conducting position where the pair of fixed terminals 17 and 18 are electrically connected together through the rotating terminal 16. This 90 degrees-rotated position is detected by the limit switch 14, and when the rotating terminal is rotated into this electrically-conducting position, the driving of the motor 4 is accurately stopped through the controller 34. By thus repeating the rotation of the rotating terminal 16, the power supply line can be automatically turned on and off.

In the above power interrupting apparatus 1, the rotating terminal 16 is rotated, and by changing the rotating positions of the outer peripheral surfaces 21*a* relative to the pair of fixed terminals 17 and 18, this power interrupting apparatus can be switched between the electrically-conducting condition and the interrupting condition, and therefore the space for moving the rotating terminal 16 is available merely by securing the space for mounting this rotating terminal 16, and this contributes to the reduced overall size of the apparatus.

In the above first embodiment, the rotation of the motor 4 is transmitted to the rotating terminal through the gear train including the worm gear 5, and therefore the rotation can be positively transmitted at a desired speed to the rotating terminal 16 without imposing an undue burden on the motor 4. Particularly, if there is provided a construction in which the rotation of the motor 4 is transmitted directly or through a minimum gear train, the overall size of the apparatus can be further reduced.

The plurality of contact springs 27 are provided at each of the outer peripheral surfaces 21 of the rotating terminal 16 serving as the electrically-conductive area, and one end of each contact spring 27 is fixed while the other end (free end) thereof projects from the outer peripheral surface 21*a*. Each of the two fixed terminals 17 and 18 has the contact surface 31*a* disposed outwardly of the path of rotation of the outer peripheral surfaces 21*a* and 24*a* of the rotating terminal 16, and the contact springs 27 can contact these contact surfaces 31*a* in a resiliently-deformed condition. Therefore, even if the gap between the rotating terminal 16 and each of the two fixed terminals 17 and 18 slightly varies, each contact spring 27 can contact the contact surface 31*a* with a sufficient contact pressure and a sufficient contact area since the distal end of the contact spring 27 is free (though the amount of resilient deformation of the contact spring 27 varies), and therefore the apparatus can be suitably used for the power supply line for flowing a large current therethrough.

In the first embodiment, the insulating frames 19 and 19 are provided outwardly of the rotating terminal 16, and are disposed at those regions where the pair of fixed terminals 17 and 18 are not disposed. These insulating frames 19 have the respective contact surfaces 19*a*, and these contact surfaces 19*a* and the contact surfaces 31*a* of the contact block portions 31 of the two fixed terminals 17 and 18 are disposed on a common circle, so that the contact surfaces 31*a* of the contact block portions 31 of the two fixed terminals 17 and 18 and the contact surfaces 19*a* of the insulating frames 19 jointly form the substantially perfect circumferential surface. Therefore, regardless of the rotating position of the rotating terminal 16, the contact springs 27 of the rotating terminal 16 can slide on the contact surfaces 31*a* and 19*a* which are spaced an equal distance from the outer peripheral surface of the rotating terminal 16, and therefore the rotating resistance of the rotating terminal 16 is kept constant regardless of the rotating position of the rotating terminal 16, and besides the amount of resilient deformation of the contact springs 27 hardly varies regardless of the rotating position of the rotating terminal 16. Therefore, the contact-opening and closing speed is stabilized, and besides wear of the contact springs 27 is reduced. Namely, if the insulating frames 19 are not provided, the contact springs 27 of the rotating terminal 16 slide in a resiliently-deformed condition on the contact surfaces 31*a* of the contact block portions 31 of the two fixed terminals 17 and 18 at those sections where the contact springs 27 pass the contact surfaces 31*a*, but the contact springs 27 merely rotate without resilient deformation and sliding movement at those sections where the contact springs 27 do not pass the contact surfaces 31*a* of the contact block portions 31 of the two fixed terminals 17 and 18. Therefore, the rotating resistance of the rotating terminal 16 varies in accordance with the rotating position, and the contact-closing and opening speed is not stable, and besides wear of the contact springs 27 increases. These disadvantages are eliminated by providing the construction of the above embodiment.

In the first embodiment, the electrically-conductive areas of the rotating terminal 16 are formed by the outer peripheral surfaces 21*a* of the electrically-conducting member 21, and the non-electrically-conductive areas of the rotating terminal 16 are formed by the outer peripheral surfaces 24*a* of the insulating isolation portions 24. Therefore, when the rotating terminal 16 is disposed in the interrupting position, the shortest distance of the conducting path between the rotating terminal 16 and each of the two fixed terminals 17 and 18 is the creeping distance along the creeping surface of each insulating isolation portion 24, and therefore is long, so that the insulating properties are enhanced. Namely, if the insulating isolation portions 24 are not provided, the shortest distance of the conducting path between the rotating terminal 16 (disposed in the interrupting position) and each of the two fixed terminals 17 and 18 is the distance of the space therebetween, and therefore is short. However, by providing the insulating isolation portions 24 as in the above embodiment, the shortest distance of the conducting path can be increased, thereby enhancing the insulating properties.

In the first embodiment, each of the contact springs 27 is inclined in such a manner that its free end is disposed downstream of its fixed end in the direction of rotation of the rotating terminal 16, and therefore during the rotation of the rotating terminal 16, the free ends of the contact springs 27 slide on the contact surface 31*a* of the fixed frame 17, 18 and the contact surface 19*a* of the resin frame 19 without impinging on these contact surfaces, and therefore the rotating terminal 16 is smoothly rotated.

In the first embodiment, the rotating terminal 16 is rotated by the driving force of the motor 4, and therefore the apparatus can be switched between the electrically-conducting condition and the interrupting condition, and therefore the electrical conduction and the interruption can be automatically effected according to the need. And besides, the conventional apparatus can not be switched between the conducting condition and the interrupting condition unless the motor is rotated in the opposite directions (that is, normal and reverse directions) In the present invention, however, the apparatus can be switched between the conducting condition and the interrupting condition by rotating the motor 4 in only one direction. Therefore, the frictional resistance between the terminals becomes more stable as compared with the conventional apparatus, and therefore there are achieved advantages that the operating force and speed of the rotating terminal 16 are stabilized, that the burden on the motor 4 and the gear grain is reduced so that the positive operation can be ensured, and that the retardation of the operation due to backlash between the gears is eliminated.

In the first embodiment, the current sensor 36 for detecting the current level of the power supply line (which can be switched between the ON-state and the OFF-state by the rotating terminal 16) is contained in the apparatus, and therefore when an abnormal current, such as a rush current and a dark current, flows through the power supply line, this can be detected. In such a case, the power supply is interrupted, and by doing so, the power interrupting apparatus 1 can have the function of a fuse, and besides the abnormal current can be suitably dealt with, that is, the circuit can be protected.

In the first embodiment, there is provided the controller 34 for controlling the driving of the motor 4, and therefore there can be positively and easily built an automatic system which, for example, prevents the battery from dying, protects the circuit, and interrupts the power supply line through the monitoring of an abnormal current. And besides, the power interruption and so on can be automatically effected by an instruction of the user at the time of the maintenance, transport and long-term storage.

In the first embodiment, there is provided the manual switch for feeding the interrupting instruction to the controller 34, and therefore the power interruption and so on at the time of the maintenance, transport and long-term storage can be effected merely by operating the manual switch by the user.

In the first embodiment, the spring receiving grooves 22*a* for receiving and fixedly holding the rail members 26 of the multi-contact spring member 25 are formed in the resin caps 22, and therefore the multi-contact spring member 25 is attached simultaneously when the pair of resin caps 22 and 22 are attached to the electrically-conducting member 21, and therefore the multi-contact spring member 25 can be easily attached. And besides, the pair of rail members 26 and 26 are received in the spring receiving grooves 22*a* in the pair of resin caps 22, and therefore the pair of rail members 26 and 26 will not form any conducting path between the fixed terminals 17 and 18 and the rotating terminal 16, and this ensures the insulating properties.

In the first embodiment, the plurality of contact springs 27 are provided at each of the outer peripheral surfaces 21 of the rotating terminal 16 serving as the electrically-conductive area, and one end of each contact spring 27 is fixed while the other end (free end) thereof projects from the outer peripheral surface 21*a*. Each of the two fixed terminals 17 and 18 has the contact surface 31*a* disposed outwardly of the path of rotation of the outer peripheral surfaces 21*a* and 24*a* of the rotating terminal 16, and the contact springs 27 can contact these contact surfaces 31*a* in a resiliently-deformed condition. Therefore, even if the gap between the rotating terminal 16 and each of the two fixed terminals 17 and 18 slightly varies, each contact spring 27 can contact the contact surface 31*a* with a sufficient contact pressure and a sufficient contact area since the distal end of the contact spring 27 is free (though the amount of resilient deformation of the contact spring 27 varies), and therefore the apparatus can be suitably used for the power supply line for flowing a large current therethrough.

In the first embodiment, the insulating frames 19 and 19 are provided outwardly of the rotating terminal 16, and are disposed at those regions where the pair of fixed terminals 17 and 18 are not disposed. These insulating frames 19 have the respective contact surfaces 19*a*, and these contact surfaces 19*a* and the contact surfaces 31*a* of the contact block portions 31 of the two fixed terminals 17 and 18 are disposed on a common circle, so that the contact surfaces 31*a* of the contact block portions 31 of the two fixed terminals 17 and 18 and the contact surfaces 19*a* of the insulating frames 19 jointly form the substantially perfect circumferential surface. Therefore, regardless of the rotating position of the rotating terminal 16, the contact springs 27 of the rotating terminal 16 can slide on the contact surfaces 31*a* and 19*a* which are spaced an equal distance from the outer peripheral surface of the rotating terminal 16, and therefore the rotating resistance of the rotating terminal 16 is kept constant regardless of the rotating position of the rotating terminal 16, and besides the amount of resilient deformation of the contact springs 27 hardly varies regardless of the rotating position of the rotating terminal 16. Therefore, the contact-opening and closing speed is stabilized, and besides wear of the contact springs 27 is reduced. Namely, if the insulating frames 19 are not provided, the contact springs 27 of the rotating terminal 16 slide in a resiliently-deformed condition on the contact surfaces 31*a* of the contact block portions 31 of the two fixed terminals 17 and 18 at those sections where the contact springs 27 pass the contact surfaces 31*a*, but the contact springs 27 merely rotate without resilient deformation and sliding movement at those sections where the contact springs 27 do not pass the contact surfaces 31*a* of the contact block portions 31 of the two fixed terminals 17 and 18. Therefore, the rotating resistance of the rotating terminal 16 varies in accordance with the rotating position, and the contact-closing and opening speed is not stable, and besides wear of the contact springs 27 increases. These disadvantages are eliminated by providing the construction of the above embodiment.

In the first embodiment, the electrically-conductive areas of the rotating terminal 16 are formed by the outer peripheral surfaces 21*a* of the electrically-conducting member 21, and the non-electrically-conductive areas of the rotating terminal 16 are formed by the outer peripheral surfaces 24*a* of the insulating isolation portions 24. Therefore, when the rotating terminal 16 is disposed in the interrupting position, the shortest distance of the conducting path between the rotating terminal 16 and each of the two fixed terminals 17 and 18 is the creeping distance along the creeping surface of each insulating isolation portion 24, and therefore is long, so that the insulating properties are enhanced. Namely, if the insulating isolation portions 24 are not provided, the shortest distance of the conducting path between the rotating terminal 16 (disposed in the interrupting position) and each of the two fixed terminals 17 and 18 is the distance of the space therebetween, and therefore is short. However, by providing the insulating isolation portions 24 as in the above embodiment, the shortest distance of the conducting path can be increased, thereby enhancing the insulating properties.

In the first embodiment, the multi-contact spring members 25 is attached simultaneously when the pair of resin caps 22 and 22 are attached to the electrically-conducting member 21, and therefore the multi-contact spring members 25 can be easily attached, and besides the pair of rail members 26 and 26 are received in the spring receiving grooves 22*a* in the pair of resin caps 22, and therefore the pair of rail members 26 and 26 will not form any conducting path between the fixed terminals 17 and 18 and the rotating terminal 16, and this ensures the insulating properties.

In the first embodiment, each of the contact springs 27 is inclined in such a manner that its free end is disposed downstream of its fixed end in the direction of rotation of the rotating terminal 16, and therefore during the rotation of the rotating terminal 16, the free ends of the contact springs 27 slide on the contact surface 31*a* of the fixed frame 17, 18 and the contact surface 19*a* of the resin frame 19 without impinging on these contact surfaces, and therefore the rotating terminal 16 is smoothly rotated.

Figure 14:
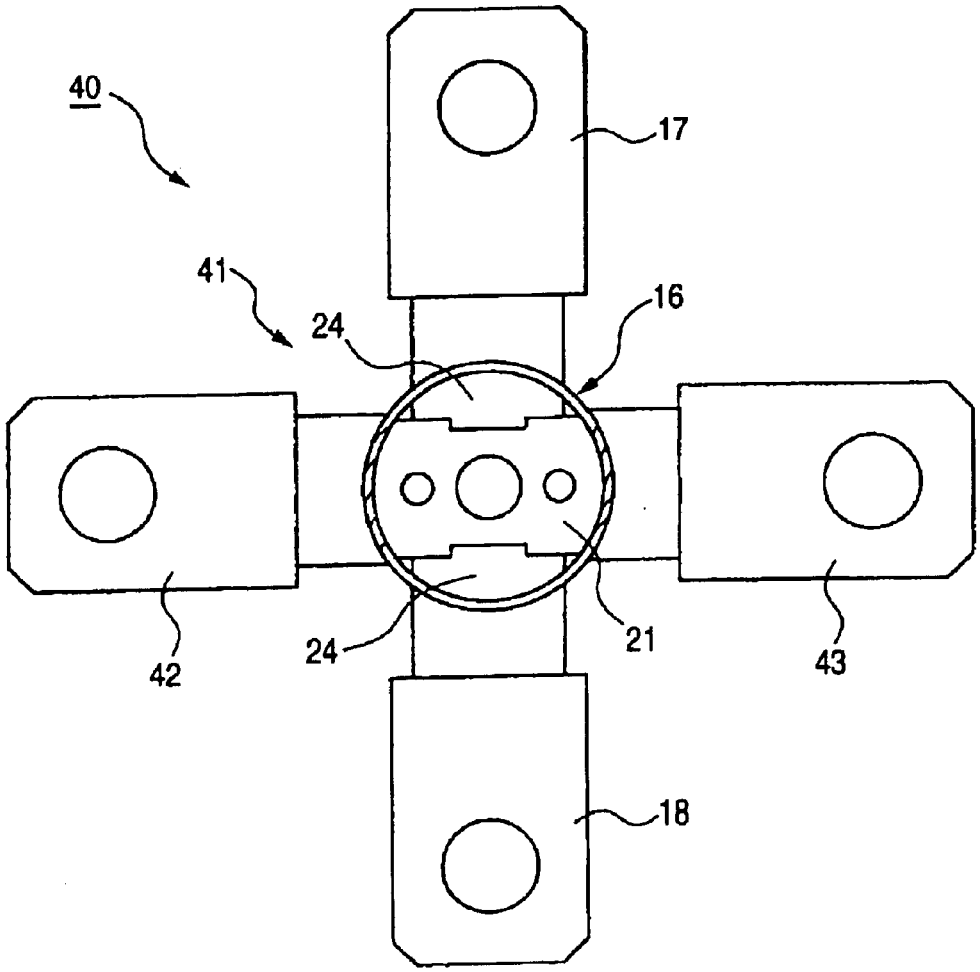
FIG. 14 shows a second embodiment of the invention, and is a front-elevational view of a terminal switching portion of a power interrupting apparatus.

FIG. 14 shows a second embodiment of the present invention, and is a front-elevational view of a terminal switching portion of a power interrupting apparatus. In the switching portion 15 of the power interrupting apparatus 1 of the above first embodiment, the pair of the fixed terminals 17 and 18 are disposed immediately adjacent to the upper and lower sides of the rotating terminal 16, respectively, and the pair of resin frames 19 and 19 are disposed immediately adjacent to the right and left sides of the rotating terminal 16, respectively, and the pair of fixed terminals 17 and 18 can be electrically connected and disconnected relative to each other. On the other hand, in the terminal switching portion 41 of the power interrupting apparatus 40 of this second embodiment, a pair of fixed terminals 17 and 18 are disposed immediately adjacent to upper and lower sides of a rotating terminal 16, respectively, and another pair of fixed terminals 42 and 43 are disposed immediately adjacent to right and left sides of the rotating terminal 16, respectively. Namely, the two pairs of fixed terminals 17, 18, 42 and 43 are arranged at intervals of 90 degrees in a rotating direction. The other construction is the same as that of the first embodiment.

In this second embodiment, circuits, connected respectively to the pair of fixed terminals 17 and 18, as well as circuits connected respectively to the pair of fixed terminals 42 and 43, can be connected and disconnected relative to each other in a switching manner.

In the second embodiment, although the two pairs of fixed terminals 17, 18, 42 and 43 are provided around the rotating terminal 16, three or more pairs of fixed terminals may be provided, in which case each of three or more sets of circuits can be connected and disconnected relative to each other in a switching manner.

In the second embodiment, although resin frames are not provided between each pair of fixed terminals 17 and 18, 42 and 43, resin frames may be provided as in the first embodiment so as to provide an interrupting condition in which each set of circuits are disconnected from each other. In this case, contact surfaces of the resin frames can be formed into an arcuate shape, and by doing so, the contact-opening and closing speed is stabilized, and besides wear of contact springs 27 can be reduced.

Figure 15:
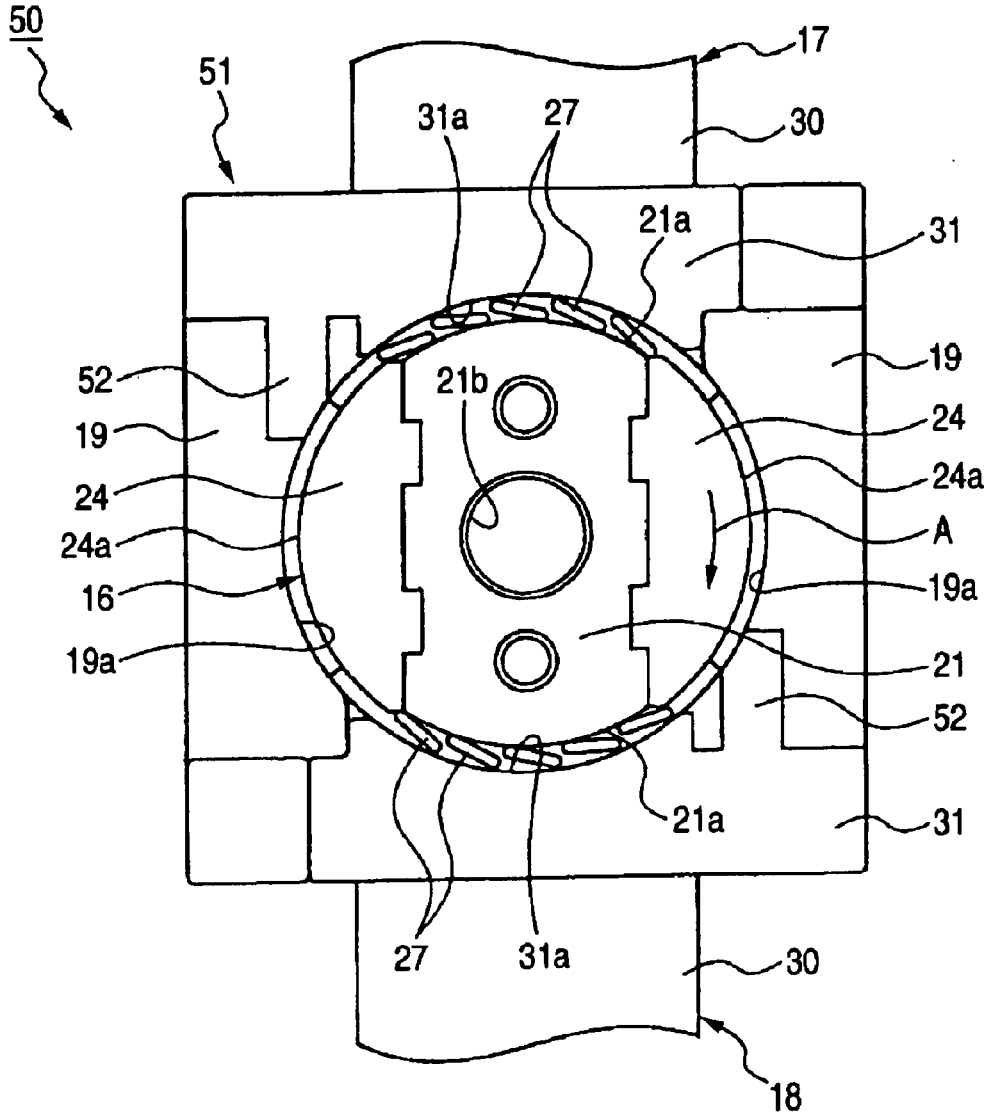
FIG. 15 shows a third embodiment, and is a front-elevational view of an important portion of a terminal switching portion of a power interrupting apparatus.
Figure 16:
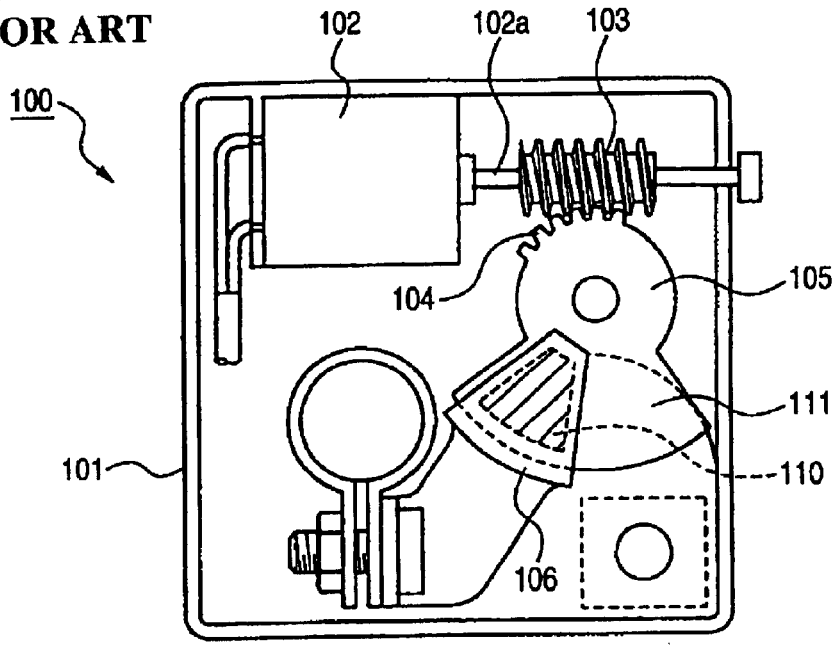
FIG. 16 PRIOR ART
FIG. 16 is a plan view of a conventional power interrupting apparatus, showing a condition in which a pivotal terminal is disposed in an electrically-conducting position.
Figure 17:
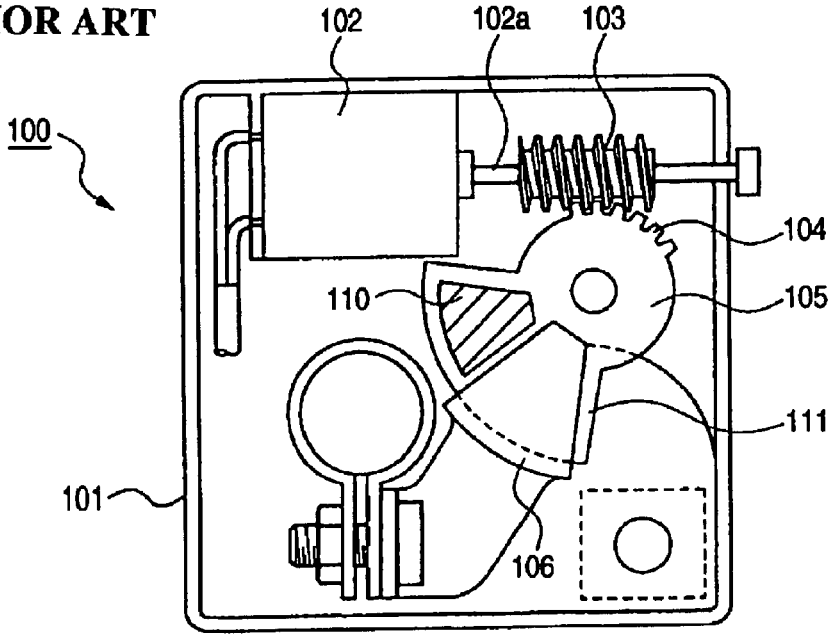
FIG. 17 PRIOR ART
FIG. 17 is a plan view of the conventional power interrupting apparatus, showing a condition in which the pivotal terminal is disposed in an interrupting position.
Figure 18:
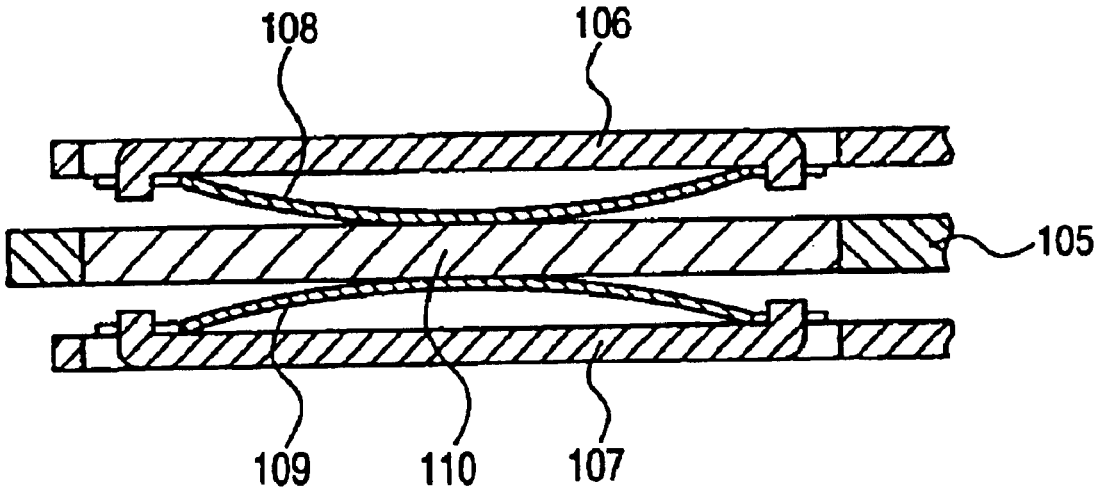
FIG. 18 PRIOR ART
FIG. 18 is a cross-sectional view showing a condition in which the pivotal terminal of the conventional apparatus is disposed in contact with a pair of fixed terminals.

FIG. 15 shows a third embodiment of the invention, and is a front-elevational view showing an important portion of a terminal switching portion of a power interrupting apparatus. As shown in FIG. 15, in the terminal switching portion 15 of the power interrupting apparatus 50 of this third embodiment, a arc discharge portion 52 is provided upstream of a contact surface 31*a* of each of fixed terminals 17 and 18 in a rotating direction. Namely, during the time when a rotating terminal 16 is rotated from an interrupting position to an electrically-conducting position, contact springs 27, disposed at an upstream side in the rotating direction, contact the arc discharge portion 52 before these contact springs 27 are brought into contact with the contact surface 31*a* of the fixed terminal 17, 18. The other construction is the same as that of the first embodiment.

In this third embodiment, arc discharge develops at each arc discharge portion 52, and therefore arc discharge will not develop at the contact surface 31*a* of each of the fixed terminals 17 and 18, and the deterioration of the contact surface 31*a* due to the arc discharge can be prevented easily and positively.

In this third embodiment, arc discharge develops at the arc discharge portions 52 if such arc discharge occurs, and therefore arc discharge will not develop at the contact surface 31*a* of each of the fixed terminals 17 and 18, and the deterioration of the contact surface 31*a* due to the arc discharge can be prevented easily and positively.

In the above embodiments, although the contact springs are provided at the rotating terminal, such contact springs may be mounted on the fixed terminals.

As described above, according to the invention, in accordance with the rotating position of the rotating terminal, the pair of fixed terminals can be switched between the electrically-conducting condition, in which the pair of fixed terminals are electrically connected together through the rotating terminal, and the interrupting condition in which the pair of fixed terminals are not electrically connected together through the rotating terminal. Therefore, the rotating terminal is rotated, and the outer peripheral surface thereof moves relative to the pair of fixed terminals, and by doing so, the switching between the electrically-conducting condition and the interrupting condition can be effected easily and positively. And besides, the space for moving the rotating terminal (moving terminal) is available merely by securing the space for mounting this rotating terminal, and therefore there can be provided the power control apparatus which can be reduced in overall size.

According to the invention, the switching between the electrically-conducting condition and the interrupting condition can be effected by the driving of the motor, and therefore the electrical connection and interruption can be automatically effected according to the need.

According to the invention, when an abnormal current, such as a rush current and a dark current, flows through the power supply line, this can be detected by the current sensor. In such a case, the power supply is interrupted, and by doing so, the power interrupting apparatus can have the function of a fuse, and besides the abnormal current can be suitably dealt with.

According to the invention, there is provided the controller for controlling the driving of the motor, and therefore there can be easily built an automatic system which, for example, prevents the battery from dying, protects the circuit, and interrupts the power through the monitoring of an abnormal current. And besides, the power interruption and so on can be automatically effected by an instruction of the user at the time of the maintenance, transport and long-term storage.

According to the invention, there is provided the manual switch for feeding the power interrupting instruction to the controller, and therefore the power interruption and so on at the time of the maintenance, transport and long-term storage can be effected merely by operating the manual switch by the user.

According to the invention, even if the gap between the rotating terminal and each fixed terminal slightly varies, each contact spring can contact the contact surface with a sufficient contact pressure and a sufficient contact area since the distal end of the contact spring is free (though the amount of resilient deformation of the contact spring varies), and therefore this apparatus can be suitably used for the power supply line of a large current.

According to the invention, regardless of the rotating position of the rotating terminal, the contact springs of the rotating terminal can slide on the contact surfaces which are spaced an equal distance from the outer peripheral surface of the rotating terminal, and therefore the rotating resistance of the rotating terminal is kept constant regardless of the rotating position of the rotating terminal, and besides the amount of resilient deformation of the contact springs hardly varies regardless of the rotating position of the rotating terminal, and therefore the contact-opening and closing speed can be stabilized, and besides wear of the contact springs can be reduced.

According to the invention, the shortest distance of the conducting path between the rotating terminal, disposed in the interrupting position, and each of the fixed terminals is the creeping distance along the creeping surface of each insulating isolation portion, and therefore is long, so that the insulating properties can be enhanced.

According to the invention, arc discharge develops at the sacrifice terminal portions if such arc discharge occurs, and therefore arc discharge will not develop at the contact surface of each fixed terminal, and the deterioration of the contact surface due to the arc discharge can be prevented easily and positively.

According to the invention, the plurality of contact springs are provided, and therefore this construction can meet with a stable large current, and besides the sacrifice terminal portion can be easily provided.

According to the invention, during the rotation of the rotating terminal, the free ends of the contact springs slide on the contact surfaces without impinging on these contact surfaces, and therefore the rotating terminal can be smoothly rotated.

According to the invention, the resin caps can be attached to the electrically-conducting member while fitting the rail member into the spring receiving grooves in the resin caps, and the rail members are covered with the resin caps, and the contact springs are exposed at the outer peripheral surface of the electrically-conducting member. Therefore, the contact springs can be easily attached, and besides the insulating properties can be enhanced in the interrupting condition.

What is claimed is:

1. A power control apparatus comprising:

a rotating terminal including a circumferential outer peripheral surface, and having electrically conductive areas and non-electrically conductive areas alternately arranged on the outer peripheral surface in a circumferential direction thereof; and a pair of fixed terminals fixed and disposed outwardly of a path of rotation of the outer peripheral surface, wherein the pair of fixed terminals is switched between an electrically conducting condition in which the pair of fixed terminals are electrically connected together through the rotating terminal, and an interrupting condition in which the electrical connection between the pair of fixed terminals through the rotating terminal is interrupted in accordance with a rotating position of the rotating terminal, wherein a multi-contact spring member is provided at the electrically conductive areas for electrically connecting the pair of fixed terminals.

2. The power control apparatus according to claim 1, wherein the rotating terminal is rotated by a driving force of a motor.

3. The power control apparatus according to claim 1, further comprising a controller for controlling the driving of the motor so as to control the electrical connection between the pair of fixed terminals and the interruption of the electrical connection.

4. The power control apparatus according to claim 1, further comprising a manual switch for feeding a power interrupting instruction to the controller.

5. The power control apparatus according to claim 1, further comprising a current sensor for detecting a current level of a power supply line, which is made conductive and is interrupted by the rotation of the rotating terminal.

6. The power control apparatus according to claim 1, wherein the pair of electrically conductive areas are symmetric with respect to an axis of rotation of the rotating terminal, and the pair of non-electrically conductive areas are symmetric with respect to the axis thereof.

7. The power control apparatus according to claim 1, wherein the multi-contact spring member includes a rail member extending between the electrically conductive areas, and a plurality of resilient contact springs projecting outwardly from the rail member at the electrically conductive areas, which is brought into contact with the pair of fixed terminal in the electrically conducting condition.

8. The power control apparatus according to claim 7, wherein the plurality of contact spring project in an inclined manner so as to extend toward a direction opposite to a rotating direction of the rotating terminal.

9. A power control apparatus comprising:

a rotating terminal including a circumferential outer peripheral surface, and having electrically conductive areas and non-electrically conductive areas alternately arranged on the outer peripheral surface in a circumferential direction thereof; and a pair of fixed terminals fixed and disposed outwardly of a path of rotation of the outer peripheral surface, wherein the pair of fixed terminals is switched between an electrically conducting condition in which the pair of fixed terminals are electrically connected together through the rotating terminal, and an interrupting condition in which the electrical connection between the pair of fixed terminals through the rotating terminal is interrupted in accordance with a rotating position of the rotating terminal, wherein an electrically-conductive contact spring is provided at the outer peripheral surface of the rotating terminal, and the contact spring is fixed at one end thereof to the outer peripheral surface while the other end thereof serving as a free end projects from the outer peripheral surface, and each of the pair of fixed terminal includes a contact surface in which the contact spring is brought into contact with the contact surface in a resiliently-deformed condition.

10. The power control apparatus according to claim 9, wherein insulating frames are disposed adjacent to the outer peripheral surface of the rotating terminal, and are provided respectively at other regions than the regions where the pair of fixed terminals are provided, and the insulating frames have respective contact surfaces, and the contact surfaces of the insulating frames and the contact surfaces of the pair of fixed terminal are disposed on a common circle, and jointly form a substantially perfect circumferential surface.

11. The power control apparatus according to claim 9, wherein the electrically-conductive areas are formed respectively of an electrically-conducting member at an outer peripheral surface, and the non-electrically conducting areas are formed respectively of isolation portions at outer peripheral surfaces.

12. The power control apparatus according to claim 11, wherein the rotating terminal comprises the electrically conducting member, and insulating resin caps attached to the electrically conducting member, and the resin cap includes a spring receiving groove in which a rail member, interconnecting the contact springs, is received and fixed held.

13. The power control apparatus according to claim 9, wherein a plurality of the contact springs are provided at the outer peripheral surface of the rotating terminal.

14. The power control apparatus according to claim 9, wherein the contact spring is inclined in such a manner that the free end of the contact spring is disposed downstream of fixed end of the contact spring in the rotating direction of the rotating terminal.

15. The power control apparatus according to claim 9, wherein the rotating terminal is rotated by a driving force of a motor.

16. The power control apparatus according to claim 9, further comprising a controller for controlling the driving of the motor so as to control the electrical connection between the pair of fixed terminals and the interruption of the electrical connection.

17. The power control apparatus according to claim 9, further comprising a manual switch for feeding a power interrupting instruction to the controller.

18. The power control apparatus according to claim 9, further comprising a current sensor for detecting a current level of a power supply line, which can is made conductive and can be interrupted by the rotation of the rotating terminal.

19. The power control apparatus according to claim 9, wherein the pair of electrically conductive areas are symmetric with respect to an axis of rotation of the rotating terminal, and the pair of non-electrically conductive areas are symmetric with respect to the axis thereof.

20. A power control apparatus comprising:

a rotating terminal including a circumferential outer peripheral surface, and having electrically conductive areas and non-electrically conductive areas alternately arranged on the outer peripheral surface in a circumferential direction thereof; and a pair of fixed terminals fixed and disposed outwardly of a path of rotation of the outer peripheral surface, wherein the pair of fixed terminals is switched between an electrically conducting condition in which the pair of fixed terminals are electrically connected together through the rotating terminal, and an interrupting condition in which the electrical connection between the pair of fixed terminals through the rotating terminal is interrupted in accordance with a rotating position of the rotating terminal, wherein each terminal of the pair of fixed terminals includes a discharging terminal portion provided upstrearn of the contact surface of the each terminal of the fixed terminals in a rotating direction of the rotating terminal.

21. A power control apparatus comprising:

a rotating terminal including a circumferential outer peripheral surface, and having electrically conductive areas and non-electrically conductive areas alternately arranged on the outer peripheral surface in a circumferential direction thereof; and a pair of fixed terminals fixed and disposed outwardly of a path of rotation of the outer peripheral surface, wherein the pair of fixed terminals is switched between an electrically conducting condition in which the pair of fixed terminals are electrically connected together through the rotating terminal, and an interrupting condition in which the electrical connection between the pair of fixed terminals through the rotating terminal is interrupted in accordance with a rotating position of the rotating terminal, wherein electrically-conductive contact spring are provided at the peripheral surfaces of the fixed terminals, and each contact spring is fixed at its one end to the peripheral surface while the other end thereof serving as a free end projects from the outer peripheral surface, and the rotating terminal has a contact surface, and the contact spring is brought into contact with the contact surface in a resiliently-deformed condition.

* * * * *